US012768082B2

(12) United States Patent
Hu et al.

(10) Patent No.: US 12,768,082 B2
(45) Date of Patent: Oct. 20, 2026

(54) HYDRATION-RESPONSIVE SILK-BASED MATERIAL, ITS USE AND PREPARATION

(71) Applicant: City University of Hong Kong, Kowloon (HK)

(72) Inventors: Jinlian Hu, Kowloon (HK); Xiaoyun Xu, Kowloon (HK)

(73) Assignee: City University of Hong Kong, Kowloon (HK)

( * ) Notice: Subject to any disclaimer, the term of this patent is extended or adjusted under 35 U.S.C. 154(b) by 172 days.

(21) Appl. No.: 18/922,846

(22) Filed: Oct. 22, 2024

(65) Prior Publication Data

US 2026/0110116 A1 Apr. 23, 2026

(51) Int. Cl.
*D01F 4/02* (2006.01)

(52) U.S. Cl.
CPC ..... *D01F 4/02* (2013.01); *D10B 2211/04* (2013.01); *D10B 2211/22* (2013.01)

(58) Field of Classification Search
CPC ..... D01F 4/02; D01F 1/10; D01F 2/02; D01F 4/00; D01F 8/02; D10B 2211/04; D10B 2211/22; D01D 1/02; D01D 5/06
See application file for complete search history.

(56) References Cited

FOREIGN PATENT DOCUMENTS

| | | | |
|---|---|---|---|
| CN | 1664184 | | 9/2005 |
| CN | 102220661 | | 10/2011 |
| CN | 103498210 A | * | 1/2014 |

OTHER PUBLICATIONS

Translation CN103498210A (Year: 2019).*
Translation 106479195A (Year: 2017).*
Harun Venkatesan, Jianming Chen, Haiyang Liu, Yoonjung Kim, Sungsoo Na, Wei Liu and Jinlian Hu; Artificial spider silk is smart like natural one: having humidity-sensitive shape memory with superior recovery stress; Mater. Chem. Front., 2019, 3, 2472.
Linpeng Fan, Jing-Liang Li, Zengxiao Cai and Xungai Wang; Bioactive hierarchical silk fibers created by bioinspired self-assembly; Nature Commun. (2021)12:2375.
Hak Jeon Kim and Won Jun Lee; The Influence of Cellulose Nanocrystal Characteristics on Regenerative Silk Composite Fiber Properties; Materials 2023, 16, 2323.
Guangqiang Fang, Yufang Huang, Yuzhao Tang, Zeming Qi, Jinrong Yao, Zhengzhong Shao and Xin Chen; Insights into Silk Formation Process: Correlation of Mechanical Properties and Structural Evolution during Artificial Spinning of Silk Fibers; ACS Biomater. Sci. Eng. 2016, 2, 1992-2000.

(Continued)

*Primary Examiner* — Elizabeth M Imani
(74) *Attorney, Agent, or Firm* — Renner, Kenner, Greive, Bobak, Taylor & Weber

(57) ABSTRACT

A method for preparing a hydration-responsive silk-based material includes the steps of: (a) providing a precursor solution including a mixture of silk fibroin, lithium bromide, and cellulose nanocrystal; (b) wet-spinning the precursor solution into a coagulation solution to form an intermediate silk-based material; and (c) drawing the intermediate silk-based material in the coagulation solution to obtain the hydration-responsive silk-based material. A hydration-responsive silk-based material prepared by such a method and the use of the hydration-responsive silk-based material are also addressed.

25 Claims, 47 Drawing Sheets
(1 of 47 Drawing Sheet(s) Filed in Color)

(56) References Cited

OTHER PUBLICATIONS

Tianjiao Jia, Yang Wang, Yuanyuan Dou, Yaowang Li, Monica Jung de Andrade, Run Wang, Shaoli Fang, Jingjing Li, Zhou Yu, Rui Qiao, Zhuangjian Liu, Yuan Cheng, Yewang Su, Majid Minary-Jolandan, Ray H. Baughman, Dong Qian, and Zunfeng Liu; Moisture Sensitive Smart Yarns and Textiles from Self-Balanced Silk Fiber Muscles; Adv. Funct. Mater. 2019, 29, 1808241.

Juming Yao, Hiromi Masuda, Chenhua Zhao, and Tetsuo Asakura; Artificial Spinning and Characterization of Silk Fiber from Bombyx mori Silk Fibroin in Hexafluoroacetone Hydrate; Macromolecules 2002, 35, 6-9.

Shengjie Ling, Zhao Qin, Chunmei Li, Wenwen Huang, David L. Kaplan and Markus J. Buehler Polymorphic regenerated silk fibers assembled through bioinspired spinning; Nature Commun. (2017) 8:1387.

Xiaoyun Xu, Zhuang Wang, Min Li, Yupei Su, Qi Zhang, Shuai Zhang and Jinlian Hu; Reconstructed Hierarchically Structured Keratin Fibers with Shape-Memory Features Based on Reversible Secondary-Structure Transformation; Adv. Mater. 2023,35,2304725.

Gustavo R. Plaza, Paola Corsini, Jose Perez-Rigueiro, Enrico Marsano, Gustavo V. Guinea and Manuel Elices; Effect of Water on Bombyx mori Regenerated Silk Fibers and Its Application in Modifying Their Mechanical Properties; J. appl. polym. sci. vol. 109, 3, 1793-1801.

Guanqiang Zhou, Zhengzhong Shao, David P. Knight, Jiaping Yan, and Xin Chen; Silk Fibers Extruded Artificially from Aqueous Solutions of Regenerated Bombyx mori Silk Fibroin are Tougher than their Natural Counterparts; Adv. Mater. 2009, 21, 366-370.

Hossein Mollahosseini, Hossein Fashandi, Akbar Khoddami, Mohammad Zarrebini and Habib Nikukar; Recycling of waste silk fibers towards silk fibroin fibers with different structures through wet spinning technique; Journal of Cleaner Production 236 (2019) 117653.

Shape memory in spider draglines; The torsional properties of spider silk add to its list of remarkable physical credentials; Nature vol. 440|Mar. 30, 2006.

José pérez-Rigueiro, Rodrigo Madurga, Alfonso M. Gañán-Calvo, Manuel elices, Gustavo V. Guinea1, Yugo tasei, Akio Nishimura, Hironori Matsuda and tetsuo Asakura; Emergence of supercontraction in regenerated silkworm (Bombyx mori) silk fibers; Sci. Rep. (2019) 9:2398 |https://doi.org/10.1038/s41598-019-38712-6.

Meiyu Cao, Bingbing Zeng, Yu Zheng and Shaoyun Guo; Biocompatible shape-memory poly(propylene carbonate)/silk fibroin blend with body temperature responsiveness; RSC Adv., 2023, 13, 13120.

Ingi Agnarsson, Ali Dhinojwala, Vasav Sahni and Todd A. Blackledge; Spider silk as a novel high performance biomimetic muscle driven by humidity; The Journal of Experimental Biology 212, 1990-1994.

Ya Yao, BenjaminJ. Allardyce, Rangam Rajkhowa, Dylan Hegh, Si Qin, KenAldrenS. Usman, PabloMota-Santiago, JizhenZhang, PeterLynch, XungaiWang, DavidL. Kaplan, and Joselito M. Razal; Toughening Wet-Spun Silk Fibers by Silk Nanofiber Templating; Macromol. Rapid Commun. 2022, 43, 2100891.

Shihui Lin, Zhen Wang, Xinyan Chen, Jing Ren, and Shengjie Ling; Ultrastrong and Highly Sensitive Fiber Microactuators Constructed by Force-Reeled Silks; Adv. Sci. 2020, 7, 1902743.

Zhen Wang, Shihui Lin, Jing Ren, Ying Pei, Min Chen, Zeming Qi, Zhengzhong Shao, Shengjie Ling; Understanding humidity-induced actuation in Antheraea pernyi silks; Giant, 3, 2020, 100029.

Xueliang Xiao and Jinlian Hu; Animal Hairs as Water-stimulated Shape Memory Materials: Mechanism and Structural Networks in Molecular Assemblies; Sci. Rep. 6, 26393; doi: 10.1038/srep26393 (2016).

* cited by examiner

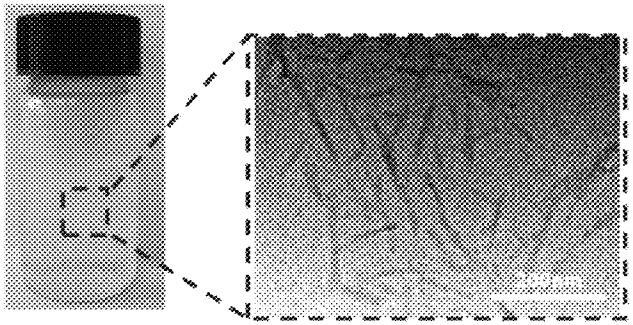
Fig. 1B
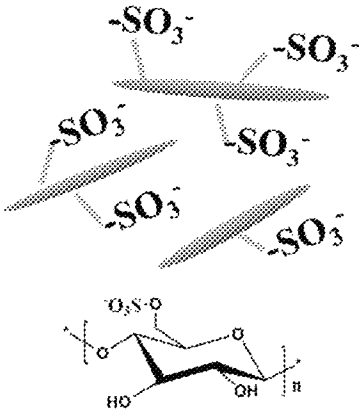
-SO3-
-SO3-
-SO3-

| strains | α-helix/ random coil | β-sheet | β-turns |
|---|---|---|---|
| 0% | 39.5% | 43.6% | 16.9% |
| 20% | 34.1% | 50.0% | 15.9% |
| 40% | 34.3% | 51.5% | 14.2% |
| 80% | 31.5% | 54.5% | 13.9% |

Fig. 23B

| Sample Name | Dry mechanical properties | | Wet mechanical properties | | Shape-memory properties | |
|---|---|---|---|---|---|---|
| | Strength (MPa) | Strain (%) | Strength (MPa) | Strain (%) | Shape fixity (%) | Shape recovery rate (%) |
| Silk fibers in this work | 104.5 ± 3.3 | 99 ± 3 | 68.4 ± 5.8 | 89 ± 8 | 88.5 ± 2.9 | 82.7 ± 0.9 |
| *B mori.* silk | 177.6 ± 21.0 | 12 ± 4 | 126.7 ± 7.7 | 20 ± 3 | 79.2 | 62 |
| Degummed silk | 138.2 ± 12.1 | 21 ± 5 | 120.7 ± 3.3 | 30 ± 3 | 0 | 0 |
| Keratin fiber (*Adv Mater* **2023**, e2304725) | 22.6 ± 2.7 | 5.54 ± 2.6 | 2.71 ± 0.28 | 362 ± 15.9 | 94.8 ± 2.2 | 81.4 ± 3.8 |
| Keratin fiber (*Nat Mater* **2021**, 20, 242) | >137 | ~100 | >14 | ~100 | 94 | 100 |
| Wool fiber (*Nat Mater* **2021**, 20, 242) | -- | -- | -- | -- | 73 | 74 |
| Artificial spider silk (*Materials Chemistry Frontiers* **2019**, 3, 2472) | 40 ± 1.2 | -- | -- | -- | 63.5 ± 1.3 | 99.3 ± 0.7 |
| Gelatin hydrogel (*RSC Adv* **2019**, 9, 18619) | -- | 0.2 | -- | 1600 | 89 | 85.6 |
| Collagen (*Materials & Design* **2020**, 186) | ~14 | ~12 | ~90 | ~140 | 69.2 | 64.7 |
| Collagen skin (*Int J Biol Macromol* **2020**, 158, 1) | -- | -- | -- | -- | 92 | 73 |
| Silk fibroin film | 37.2 | 56.3 | -- | -- | 98 | 80 |

Fig. 29B

HYDRATION-RESPONSIVE SILK-BASED MATERIAL, ITS USE AND PREPARATION

TECHNICAL FIELD

The present invention relates to a method for preparing a hydration-responsive material, for example, particularly, but not exclusively, a hydration-responsive silk-based material. The present invention also pertains to a hydration-responsive silk-based material prepared by the method and the use of the hydration-responsive silk-based material.

BACKGROUND OF THE INVENTION

As a major branch of stimulus-responsive materials, shape memory fibers have been applied to many important fields, including aerospace, textiles and clothing, and biomaterial devices. Typically, stimulus-responsive materials such as stimulus-responsive fibers are manufactured from synthetic polymer. However, as smart device has become more common and popular, there is a growing demand for smart fibers having self-healing properties, shape memory effects and/or stimuli-actuated properties etc. There is also a growing demand for smart fibers with improved biocompatibility, biodegradability, and environmentally friendliness. Meanwhile, it is believed that it remains a challenge to balance the mechanical properties and stimuli-responsiveness in the reported stimulus-responsive materials.

The present invention thus seeks to eliminate or at least mitigate such shortcomings by providing a new or otherwise improved method for preparing a stimuli-responsive material, such as a hydration-responsive material.

SUMMARY OF THE INVENTION

In a first aspect of the present invention, there is provided a method for preparing a hydration-responsive silk-based material, comprising the steps of: (a) providing a precursor solution including a mixture of silk fibroin, lithium bromide, and cellulose nanocrystal; (b) wet-spinning the precursor solution into a coagulation solution to form an intermediate silk-based material; and (c) drawing the intermediate silk-based material in the coagulation solution to obtain the hydration-responsive silk-based material.

Optionally, step (a) comprises the steps of: providing a silk fibroin solution from a natural silk; providing a suspension solution of cellulose nanocrystal; and mixing the silk fibroin solution with the suspension solution of cellulose nanocrystal to form the precursor solution.

It is optional that the silk fibroin solution includes a mixture of silk fibroin and lithium bromide.

Optionally, the silk fibroin solution is prepared by the steps of: degumming the natural silk in an aqueous solution of sodium bicarbonate to obtain the silk fibroin; and dissolving the silk fibroin in an aqueous solution of lithium bromide.

It is optional that the degumming is carried out in a 2% sodium bicarbonate aqueous solution at a temperature of about 90° C. to about 100° C.

Optionally, the dissolving step is carried out by dissolving about 25% by weight of silk fibroin in about 8.8 M to about 9.3 M lithium bromide aqueous solution at a temperature of about 60° C.

It is optional that the natural silk is obtainable from larvae of any one of *Bombyx mori, Antheraea, Cricula, Samiz*, or *Gonometa*.

In an optional embodiment, the precursor solution includes about 20% of silk fibroin and about 0.1% to about 2% of cellulose nanocrystal.

It is optional that the cellulose nanocrystal is a sulfate-functionalized cellulose nanocrystal.

Optionally, the wet-spinning is carried out by extruding the precursor solution into a 30% ammonium sulfate aqueous solution at a rate of about 0.8 mL/h to form the intermediate silk-based material.

It is optional that step (b) includes the step of stabilizing the intermediate silk-based material in the coagulation solution.

Optionally, step (c) is carried out at a drawing ratio from about 200% to about 600%.

In an optional embodiment, the method further comprises the step of converting the hydration-responsive silk-based material into a ply yarn.

Optionally, the method comprises the step of plying the hydration-responsive silk-based material into a single-ply yarn or a multiple-ply yarn.

In an optional embodiment, the method comprises the step of sewing the ply yarn on a fabric.

In a second aspect of the present invention, there is provided a hydration-responsive silk-based material prepared by the method in accordance with the first aspect, comprising a hierarchical fiber structure of a plurality of cellulose nanocrystal-doped silk fibroins.

Optionally, the plurality of cellulose nanocrystal-doped silk fibroins includes a plurality of cellulose nanocrystal-doped silk fibrils arranged in stack and aligned parallel to a fiber axis.

It is optional that the plurality of cellulose nanocrystal-doped silk fibrils includes a semi-crystalline structure of β-sheet crystallites and amorphous-helix/random coils doped with cellulose nanocrystals via hydrogen bond.

In an optional embodiment, the semi-crystalline structure includes a nematic phase.

Optionally, the cellulose nanocrystals are sulfate-functionalized cellulose nanocrystals having a diameter of about 5 nm to about 20 nm and a length of about 100 nm to about 200 nm.

In an optional embodiment, the hydration-responsive silk-based material is a shape-memory and stress-memory fiber that is responsive to hydration-dehydration cycles.

Optionally, the hydration-responsive silk-based material has a shape fixity of about 90% and a recovery efficiency of about 83% during a shape-memory programming cycle.

In an optional embodiment, the hydration-responsive silk-based material is configured as a ply yarn.

Optionally, the ply yarn has a clockwise torsion in response to a humid condition and has a counterclockwise torsion in response to a dry condition.

In an optional embodiment, the ply yarn is sewable on a fabric.

BRIEF DESCRIPTION OF DRAWINGS

The patent or application file contains at least one drawing executed in color. Copies of this patent or patent application publication with color drawing(s) will be provided by the Office upon request and payment of the necessary fee.

The invention will now be more particularly described, by way of example only, with reference to the accompanying drawings, in which:

FIG. 1A is a schematic illustration of the sulfate-functionalized cellulose nanocrystals (CNCs);

FIG. 1B is a photo showing after extraction and dialysis, the CNCs were distributed evenly in the water, seen as a milky suspension. The spindle-like CNCs were observed under TEM;

FIG. 23B is a table summarizing the Secondary structural components of the silk fibers under different strains;

FIG. 29B is a table summarizing the mechanical properties and shape-memory properties of the regenerated silk fibers in this work and the reported hydration-responsive protein-based materials;

DETAILED DESCRIPTION OF OPTIONAL EMBODIMENT

Figure 1C:
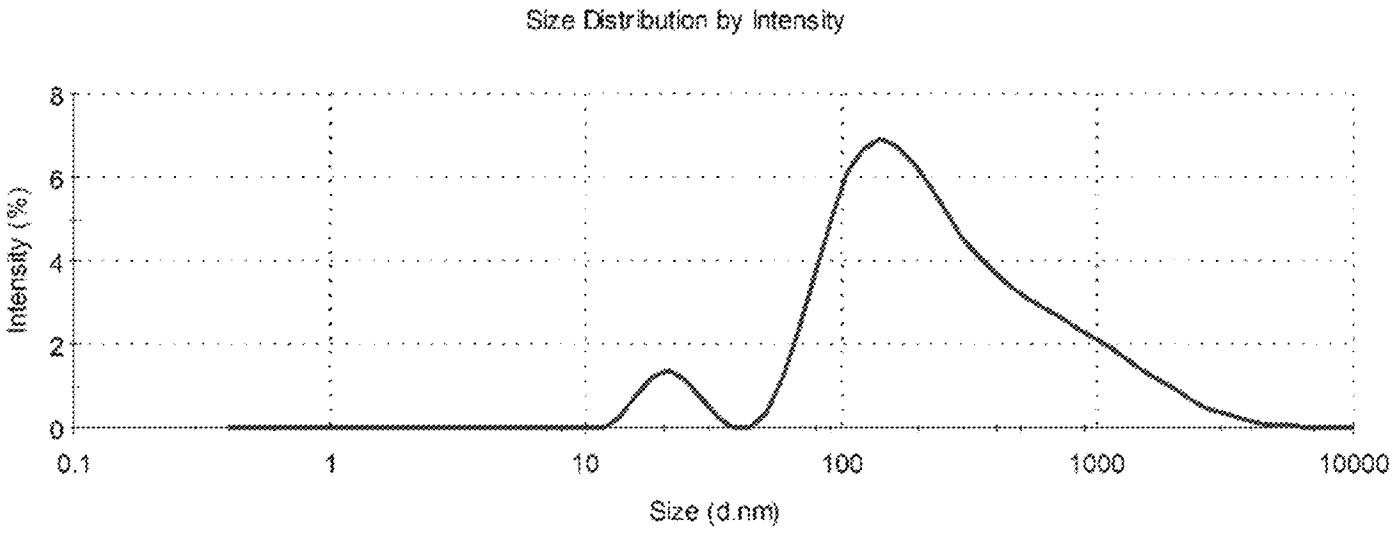
FIG. 1C shows the size distribution and zeta potential of the as-prepared CNCs measured using a Malvern laser particle size analyzer. The detected zeta potential for CNC suspension is −60.2 mV, indicating an even dispersion. CNCs have an average length of 151 nm and an average diameter of 20 nm.

As used herein, the forms "a", "an", and "the" are intended to include the singular and plural forms unless the context clearly indicates otherwise.

The words "example" or "exemplary" used in this invention are intended to serve as an example, instance, or illustration. Any aspect or design described in this disclosure as "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or". That is, unless specified otherwise or clear from context, "X employs A or B" is intended to mean any of the natural inclusive permutations. That is, if X employs A, X employs B, or X employs both A and B, then "X employs A or B" is satisfied under any of the foregoing instances.

As used herein, the phrase "about" is intended to refer to a value that is slightly deviated from the value stated herein. Various examples have been described throughout the present disclosure.

Natural silk generally includes a hydrogen bond-rich semi-crystalline structure containing tightly-stacked β-sheet crystallites and a loosely dispersed (amorphous) α-helix/random coil matrix. Without wishing to be bound by theory, it is believed that the reversible hydrogen bonding in the amorphous region and the transition from α-helix/random coils to β-sheet may contribute to the water-actuated behavior of any silk-based materials. Thus, it is believed that by fabricating a semi-crystalline structure with β-sheet crystals embedded in the amorphous cx-helix/random coils and an anisotropic organization, it may render a material such as a silk-based material water-responsive with sufficient mechanical properties that may meet the needs of engineering processing such as sewing and weaving. The inventors have, through their own research, trials, and experiments, devised that by treating silk fibroin with lithium bromide and cellulose nanocrystals (CNCs), the silk fibrils of the silk fibroin may be facilitated to self-organize into a nematic phase under shear stress, thereby allowing the development of anisotropic alignment, and that the crystal alignment may be further adjusted by post-drawing processes.

In accordance with some embodiments of the present invention, such a silk-based material may exhibit water-triggered shape-memory effect as well as water-driven cyclic response. For example, such a silk-based material may exhibit a shape recovery rate of about 83% and generate a maximum actuation stress of up to 18 MPa during the water-driven cyclic contraction, suggesting its potential use in water-driven actuators, artificial muscle, and smart fabrics based on the integration of suitable mechanical properties and water responsiveness, etc.

In a first aspect of the present invention, there is provided a method for preparing a hydration-responsive silk-based material, comprising the steps of: (a) providing a precursor solution including a mixture of silk fibroin, lithium bromide, and cellulose nanocrystal; (b) wet-spinning the precursor solution into a coagulation solution to form an intermediate silk-based material; and (c) drawing the intermediate silk-based material in the coagulation solution to obtain the hydration-responsive silk-based material.

Step (a) may involve the steps of: providing a silk fibroin solution from a natural silk; providing a solution of cellulose nanocrystal; and mixing the silk fibroin solution with the solution of cellulose nanocrystal to form the precursor solution. In particular, the silk fibroin solution may include a mixture of silk fibroin and lithium bromide.

In some embodiments, the silk fibroin solution may be prepared by the steps of: degumming the natural silk in an aqueous solution of sodium bicarbonate to obtain the silk fibroin; and dissolving the silk fibroin in an aqueous solution of lithium bromide. For example, in some embodiments, the natural silk may be degummed by heating it in a 2% sodium bicarbonate aqueous solution at a temperature of about 90° C. (such as from 88.5° C. . . . 89° C. . . . 89.8° C., 89.9° C., 90° C. . . . 91.4° C. . . . to 92° C.) to about 100° C. (such as from 98.5° C. . . . 99° C. . . . 99.5° C., 99.9° C., 100° C.) for about 30 min (such as 27 minutes, 28 minutes, 29 minutes, 30 minutes, 31 minutes, 32 minutes) to about 45 minutes (such as 43 minutes, 44 minutes, 45 minutes, 46 minutes, 47 minutes). Optionally or additionally, the degummed natural silk may be isolated by washing it with deionized water several times such as 3-5 times and then be dried under air or at an elevated temperature to obtain the (dried) silk fibroin.

The natural silk may be obtainable from larvae of any one of *Bombyx mori* (*B. mori*), *Antheraea, Cricula, Samiz*, or *Gonometa*. As a specific embodiment, the natural silk may be obtained from larvae of any one of *Bombyx mori*, i.e., the natural silk is a *B. mori* silk.

Then, the silk fibroin may be dissolved in an aqueous solution of lithium bromide to obtain the silk fibroin solution. In some embodiments, about 25% by weight (such as 23.9%, 24% . . . 24.5% . . . 25% . . . 25.1% . . . 25.2%) of silk fibroin may be dissolved in about 8.8 M (such as 8.65 M . . . 8.7 M . . . 8.78 M . . . 8.8 M, 8.81 M . . . 8.86 M . . . 8.9 M and the like) to about 9.3 M (such as 9.2 M . . . 9.25 M . . . 9.29 M, 9.3 M . . . 9.31 M . . . 9.4 M and the like) lithium bromide aqueous solution at a temperature of about 60° C. (such as 58° C. . . . 58.8° C. . . . 59.4° C. . . . 59.6° C. . . . 60° C. . . . 60.2° C. . . . 61.3° C. . . . 62° C. and the like). In particular, it is believed that lithium bromide is a chaotropic salt that is capable of breaking the inter- and intramolecular H-bonds. Without wishing to be bound by theory, such a high concentration of lithium bromide was used to facilitate the unfolding of the silk fibrils thereby allowing the silk fibrils to be freed from the silk. It is also believed that the bond-breaking action by the lithium bromide would not destroy the backbones of the silk fibrils or silk nanofibrils, therefore providing a favorable condition for the β-sheet folding and anisotropic alignment during subsequent wet-spinning process which involves shear stress and spatial constraint.

A suspension solution of cellulose nanocrystal may be provided simultaneously or separately. In some embodiments, the suspension solution of cellulose nanocrystal may be prepared by suspending/dispersing a microcrystalline cellulose in a suitable solvent. The suitable solvent may vary in accordance with the practical needs. For example, in an embodiment where the cellulose nanocrystal may be a sulfate-functionalized cellulose nanocrystal, the suspension solution thereof may be prepared by dispersing the microcrystalline cellulose in sulfuric acid (such as about 60% to about 70% sulfuric acid) under heating, such as at a temperature of about 60° C. to about 70° C., about 59° C. to about 71° C., about 60° C. to about 68° C., about 59° C. to about 69° C., about 62° C. to about 70° C., about 60° C. to about 66° C., about 63° C. to about 66° C. and the like, followed by adjusting the pH of this acidic suspension solution to pH about 4 with water, forming an aqueous suspension solution of sulfate-functionalized cellulose nanocrystal. In some example embodiments, the pH adjustment may be performed by dialyzing the acidic suspension solution with, for example, deionized water until the pH of the acidic suspension solution is stabilized at about 4. In some particular example embodiments, the pH adjustment may be performed for 7 days or more, until the pH of the acidic suspension solution is stabilized at about 4.

In some embodiments, the suspension solution of cellulose nanocrystal may be prepared as a stock (suspension) solution with 3% cellulose nanocrystal and the stock (suspension) solution may then be used to mix with the silk fibroin solution as described herein to form the precursor solution with desired concentration of silk fibroin and cellulose nanocrystal. In some particular embodiments, the precursor solution may include about 20% (such as 19.5% . . . 19.9%, 20%, 20.1% . . . 20.5% and the like) of silk fibroin and about 0.1% (such as 0.088% . . . 0.09% . . . 0.095% . . . 0.1% . . . 0.102% . . . 0.11% . . . 0.12% and the like) to about 2% (such as 1.9% . . . 1.92% . . . 1.95% . . . 2% . . . 2.01% . . . 2.1% and the like) of cellulose nanocrystal.

As mentioned, in some particular embodiments, the cellulose nanocrystal may be a sulfate-functionalized cellulose nanocrystal, i.e., the hydroxyl groups of the cellulose nanocrystal may be hydrolyzed by sulfuric acid to become sulfate groups. Without wishing to be bound by theory, it is believed that with the presence of sulfate group, on the one hand, it would render the cellulose nanocrystal negatively charged and therefore facilitate an even distribution of the cellulose nanocrystal in the (precursor) solution; on the other hand, taking together the negatively charged silk fibroin into account, the charge screening effect could promote protein-protein interaction and the self-organization of silk fibrils into a nematic crystal phase with the assistance of the cellulose nanocrystals.

The precursor solution as described herein may be loaded to any suitable device for carrying the wet-spinning process. In some embodiments, the wet-spinning may be carried out by extruding the precursor solution into an antisolvent, such as a 30% ammonium sulfate aqueous solution to form the intermediate silk-based material. For example, the precursor solution may be loaded into an extruding system comprising a syringe pump and a syringe having a spinning needle operably coupled to the syringe pump. The precursor solution may be extruded at rate of about 0.8 mL/h (such as 0.77, 0.78, 0.79, 0.8, 0.81, 0.82 mL/h and the like) to the ammonium sulfate aqueous solution (i.e., the coagulation solution or coagulation bath) by the action of the syringe pump.

After the precursor solution is extruded into the coagulation solution, optionally or additionally, the as-formed intermediate silk-based material may be allowed to rest/stay in the coagulation solution for stabilization. In some optional or additional embodiments, the as-formed intermediate silk-based material may be allowed to stay in the coagulation solution for about 20 minutes to about 40 minutes for stabilization.

The intermediate silk-based material may then be subjected to post-drawing treatment in the coagulation solution to obtain the hydration-responsive silk-based material. In some embodiments, the stabilized intermediate silk-based material may be post-drawn in the coagulation solution at a drawing ratio of about 200% to about 600% (i.e., about 2 times to about 6 times). As used herein, the term "drawing ratio" generally denotes the ratio of drawn fiber length to the starting/original length during the fiber spinning process. Without wishing to be bound by theory, it is believed that the post-drawing treatment in the coagulation solution may induce the alignment of the protein molecules of the intermediate silk-based material, which in turn allows the peptides to undergo self-folding into β-sheets and to generate crystallites more easily, leading to significantly-robust mechanical properties and anisotropy of the hydration-responsive silk-based material as a result.

Optionally or additionally, as-obtained hydration-responsive silk-based material may be isolated from the coagulation solution by washing it with deionized water.

In some embodiments, the method as descried herein may further including the step of converting the hydration-responsive silk-based material into a ply yarn, such as by plying the hydration-responsive silk-based material into a single-ply (such as Z-twist or S-twist) yarn or a multiple-ply yarn (such as 2-ply yarn, 3-ply yarn, 4-ply yarn and the like).

In some particular embodiments, the method as described herein may include the step of sewing the ply yarn on a fabric such as a woven fabric for smart thermal management.

In a second aspect of the present invention, there is provided a hydration-responsive silk-based material prepared by the method as described herein. The hydration-responsive silk-based material may comprise a hierarchical fiber structure of a plurality of cellulose nanocrystal-doped silk fibroins. As used herein, the term "hierarchical fiber structure" may generally denotes the complex architecture where the fibers are organized in multiple levels of structural complexity, from nano to macro scale. As an exemplary embodiment, the hydration-responsive silk-based material as described herein may include β-sheet crystallites and amorphous α-helix/random coils as well as cellulose nanocrystals (nano scale) combined to form microfibrils or protofibrils (micro scale) which may be bundled to form fibrils (meso scale) which are further assembled into fibers (macro scale).

In some embodiments, the plurality of cellulose nanocrystal-doped silk fibroins includes a plurality of cellulose nanocrystal-doped silk fibrils arranged in stack and aligned parallel to a fiber axis. In particular, the plurality of cellulose nanocrystal-doped silk fibrils may include a semi-crystalline structure of β-sheet crystallites and amorphous α-helix/random coils doped with cellulose nanocrystals via hydrogen bond, and such a semi-crystalline structure may have a nematic phase arrangement.

In some embodiments, the cellulose nanocrystals may be sulfate-functionalized cellulose nanocrystals having a diameter of about 5 nm to about 20 nm and a length of about 100 nm to about 200 nm.

As used herein, the phrase "hydration-responsive" generally denotes that the properties of a material may change when the material is in contact/is removed from or absorbs/desorbs liquid form or gaseous form of water (i.e., liquid water, aqueous solution, moisture, steam and the like). For example, in some embodiments where the hydration-responsive silk-based material as described herein may be a shape-memory and stress-memory fiber that is responsive to hydration-dehydration cycles. In these embodiments, the hydration-responsive silk-based material may have a shape fixity of about 90% and a recovery efficiency of about 83% during a shape-memory programming cycle (i.e., stretching such as to about 20% of the original length under wet/humid conditions for e.g., about 25 seconds, fixing under dry (ambient) conditions such as for about 180 seconds, and recovering under wet conditions such as for about 5 min).

In some embodiments, the hydration-responsive silk-based material may be configured as a ply yarn such as a single-ply (such as Z-twist or S-twist) yarn or a multiple-ply yarn (such as 2-ply yarn, 3-ply yarn, 4-ply yarn and the like). in some particular embodiments, the ply yarn may have a clockwise torsion in response to a humid condition (such as under 100% relative humidity) and has a counterclockwise torsion in response to a dry condition (such as under a temperature of about 25° C. (i.e. room temperature) and a relative humidity of about 30% to 60%).

In some embodiments, the hydration-responsive silk-based material may be a ply yarn and is sewable on a fabric. For example, the ply yarn may be sewed to form a portion of a fabric or may be sewed to form a whole piece of fabric. In either case, such a fabric may be further sewed on another fabric such as clothing and the like for practical use. In some example embodiments, the fabric including the ply yarn of the hydration-responsive silk-based material as described herein may be expandable under wet/humid conditions and may be shrinkable/contractible upon drying, suggesting the potential use of the hydration-responsive silk-based material as described herein for thermal management.

Hereinafter, the present invention is described more specifically by way of examples, but the present invention is not limited thereto.

EXAMPLES

Materials and Methods

Materials

LiBr (>99.5%), $NaHCO_3$(AR, 99%), sulfuric acid (AR, 98%), and $(NH_4)_2SO_4$ (>99%) were purchased from Aladdin, Shanghai. *B mori*. Silk was obtained from a local market. Unless otherwise stated, the silk spinning dopes or the regenerated silks as discussed below have a CNC concentration of 1% and a drawing ratio of 6×.

Characterization

Nematic and Rheological Properties

Flow behavior and dynamic rheological properties of silk fibroin spinning dope were measured using an Anto-Paar MCR 502 Rheometer with a 25 mm rotor under 25° C., within the shear rate ranging from 0.01 to 100 $s^{-1}$. The consistency coefficient (K) and non-Newtonian exponent (n) were calculated according to the following equation:

$$\tau = K\gamma^{n-1},$$

where τ is the shear stress and γ is the shear rate.

The nematic texture of the spinning dope was observed and recorded using a polarized optical microscope and SAXS (Rigaku X-ray Diffractometer SmartLab™ 9 kW, CuKalpha radiation, λ=1.5418 Å) with spinning dope loaded in a glass capillary. For the SAXS measurements, the glass capillary was set perpendicular to the X-ray beam.

Morphological Observation

Regenerated silk fibers were adhered to an aluminum holder by conductive tape and coated with a thinner layer of gold. The observation was conducted in a scanning electron microscope (e-SEM, FEI, Quanta 250) at an accelerating voltage of 5 kV.

Anisotropic and Crystallinity Analysis

Polarized optical microscopy (POM, Zeiss) was used to examine the birefringence, to evaluate the anisotropy of the fibers. WXRD tests were conducted on a Rigaku X-ray Diffractometer SmartLab™ 9 kW, using CuKalpha radiation (2=1.5418 Å). A single regenerated silk fiber was fixed on a glass slide and observed from 0° to 45° under cross polarizers. TGA and DSC (for the analysis of the crystallinity), were undertaken using STA (STA 6000, PerkinElmer), heating from 30 to 800° C., at 10° C./min.

Secondary Structure Characterization

The secondary structure of the regenerated silk fibers was characterized by analyzing the amide I region of the FTIR spectrum. FTIR spectra were detected and recorded on an FT-IR Spectrometer (PerkinElmer), scanning over a wavelength range of 1800 to 1400 $cm^{-1}$ with a resolution of 4 $cm^{-1}$. Software PeakFit v4.12 was used for peak deconvolution and analysis of the Amide I region from 1600 to 1700 $cm^{-1}$. In the amide I region, the deconvoluted peak at 1620 $cm^{-1}$ represents β-sheets, 1650 $cm^{-1}$ represents α-helix/random coils, and 1680 $cm^{-1}$ represents β-turns.

Mechanical Properties Testing

The mechanical properties of the regenerated silk fibers were evaluated using an Instron 5942 Micro Tester equipped with a 50 N transducer. A humidifier was placed next to the clamps during testing. For the tensile test, a single fiber was clamped with a gauge length of 2 cm and tested with a constant cross-head speed of 5 mm min-1. Fibers under dry and wet conditions were tested respectively with the same parameters. For the wet tensile testing, fibers were fully soaked in deionized water for 10 minutes before the test.

Water-Responsiveness

Two types of tests were conducted to evaluate the interaction between water and the regenerated silk fibers. The shape memory effect testing procedure was also conducted on a single fiber with a gauge length of 2 cm and a cross-head speed of 5 mm min-1. The full cycle procedure can be divided into three steps: 1. The fiber was stretching to 10% strain under wet conditions; 2. The fiber was held under 10% strain for 3 min until the fiber was dried; 3. The clamp returned to its original position.

To observe the humidity sensitivity of a single regenerated silk fiber, an 8 cm length fiber was suspended with 100 mg and 400 mg metal clips. The variation of the fiber length under 40% and 90% RH were recorded by a camera. To quantify the water responsiveness, a single fiber was held on the Instron Micro Tester 5942 at a constant length of 2 cm, and the force under dry and wet conditions was recorded. The silk was mounted on the grips of the Instron Micro Tester at a strain of 0.5%. The test started under wet conditions and before the test, fibers were fully soaked in water to release any internal stress. Software ImageJ was used to measure the length variation in pixels. The work density (Wd) was calculated using the following equation:

$$Wd = \frac{w}{v},$$

where w is the work performed, obtained by F (force)×h (displacement), v is the volume of the silk fiber.

Yarn Artificial Muscle and Textile Applications

Silk fibers were twisted and folded to form an artificial muscle yarn with a balanced twist. A 2-cm yarn was suspended with a 100 mg metal clip, and the hydration torsional responsiveness was recorded using a camera. A navy-blue cloth was chosen as the substrate, and then a three-ply silk yarn was sewed in a woven texture onto the substrate to obtain a two-layer fabric. The fabric was treated with several wetting and drying cycles, and the shape change recorded.

Statistical Analysis

Experimental errors were calculated as the standard error of the mean using a sample size of N=3. Experimental data are presented as mean values±standard deviation. Statistical analysis was conducted on Origin 2023.

Example 1

Preparation of Spinning Dopes and Regenerated Silk Fiber

Firstly, the sulfate-functionalized CNCs (FIG. 1A) were obtained by sulfuric acid hydrolysis. Briefly, microcrystalline cellulose was suspended in 64% sulfuric acid and heated for 45 min under 65° C. The hydrolysis was stopped by adding iced water, and the solid content (i.e., the sediment/residues after quenching the hydrolysis) was collected by centrifugation. The CNCs obtained were dialyzed against deionized water for a week until the pH reaches about 4 and remained unchanged. The morphology of CNCs was observed under TEM (FIG. 1B), and the size of the CNCs was measured using a Malvern Laser Particle Size Analyzer. (FIG. 1C). The CNCs (suspension) were concentrated to about 3% for further use. Without wishing to be bound by theory, it is believed that the CNCs suspension as prepared in accordance with the present disclosure would lead to a more even dispersion as compared with the case where the CNCs suspension is directly formed from CNCs powder or CNCs gel. Furthermore, it is believed that the CNCs suspension as described herein would have minimized agglomeration and/or sedimentation in light of the negative charge of the CNCs.

*B mori*. Silk was degummed to remove sericin by boiling the raw silk in 2% $NaHCO_3$ aqueous solution for 30 min, followed by washing in deionized water several times. After being dried in air, the silk was dissolved with a concentration of 25% in 9.3 M LiBr at 60° C. The CNC solutions were blended with silk solution to form a spinning dope with desired final concentration. The final concentration of silk fibroin was 20%, and concentrations of CNC were 0%, 0.25%, 0.5%, 1.0%, and 1.1% respectively. After degassing by centrifuge, the spinning dope was loaded to an extrusion device equipped with a syringe pump and a 27-21 G spinning needle for ejecting the spinning dope into the coagulation bath (30% $(NH_4)_2SO_4$) at a rate of about 0.8 mL/h. The as-spun fibers were drawn to the desired ratio (2×, 4×, 6×) in the coagulation bath and dried in air.

Example 2

Design and Fabrication Approach of the Water-Responsive Silk Fibers

Figure 2:
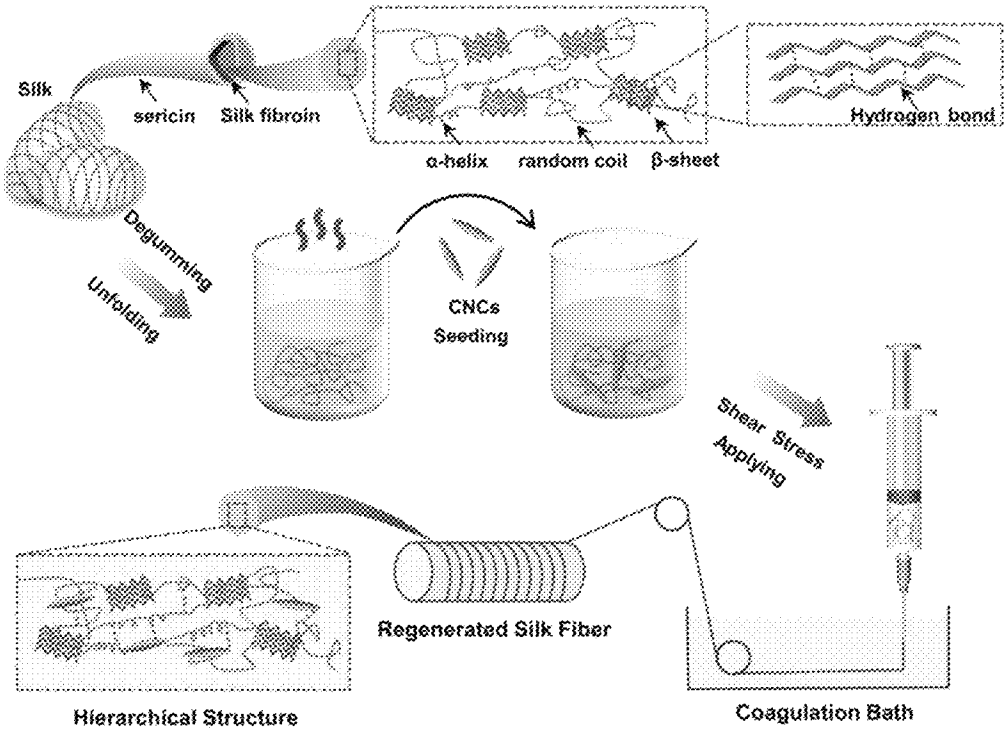
FIG. 2 is a schematic diagram illustrating the procedures of the preparation of spinning dope from *B. mori* silk and CNCs and the wet-spinning process of the regenerated silk fibers. The regenerated silk fibers have a semi-crystalline structure.

With reference to FIG. 2, natural silk contains two parallel silk fibroins wrapped by an outer layer of sericin. Each of the silk fibroins contain nanofibrils that are constrained in the fiber by strong hydrogen bonds and ionic forces. The nanofibrils include hydrogen bonds-rich semi-crystalline structure containing tightly-stacked β-sheet crystallites and a loosely dispersed α-helix/random coil matrix, and the α-helix and random coils are arranged hierarchically into an anisotropic fibrillar structure that enables their axial reversible deformation under external force.

Figure 3:
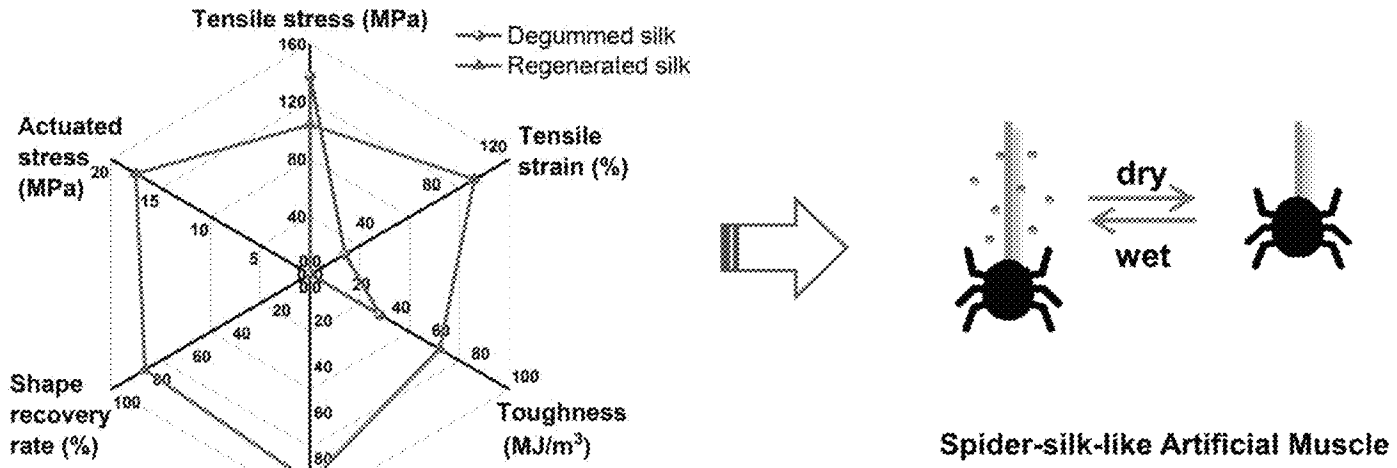
FIG. 3 shows the properties comparison between natural degummed silkworm silk and regenerated silk (left) and a schematic illustration of water-actuated shape change phenomenon of the regenerated silk fiber of this work that is similar to the spider silk for acting as an artificial muscle (right)

Based on the above, it is believed that the silk fibrils can be unfolded and freed from the silks by incubating in a high concentration of lithium bromide (LiBr) solution, as LiBr is a chaotropic salt that can break the inter- and intramolecular H-bonds. Meanwhile, highly-crystalline CNCs were chosen as the seeding segments to accelerate the silk molecular folding as it is believed that crystalline nanomaterials may show a strong seeding effect. A shear stress is then applied to the spinning dope using a syringe pump to enable molecular nucleation and fibril alignment. The fibers are solidified in a coagulation bath and enhanced by the subsequent post-drawing treatment (FIG. 2). Thus, a hierarchical and semi-crystalline structure is believed to be achieved in the present regenerated silk fibers. This design renders the present regenerated silk fibers better mechanical properties and better shape-memory performance compared to natural silkworm silk (FIG. 3, left), which may allow the present regenerated silk fibers to act as a water-driven artificial muscle in a similar way to spider silk (FIG. 3, right).

Example 3

Nematic Characteristics and Rheological Properties in Spinning Dopes

Figure 4:
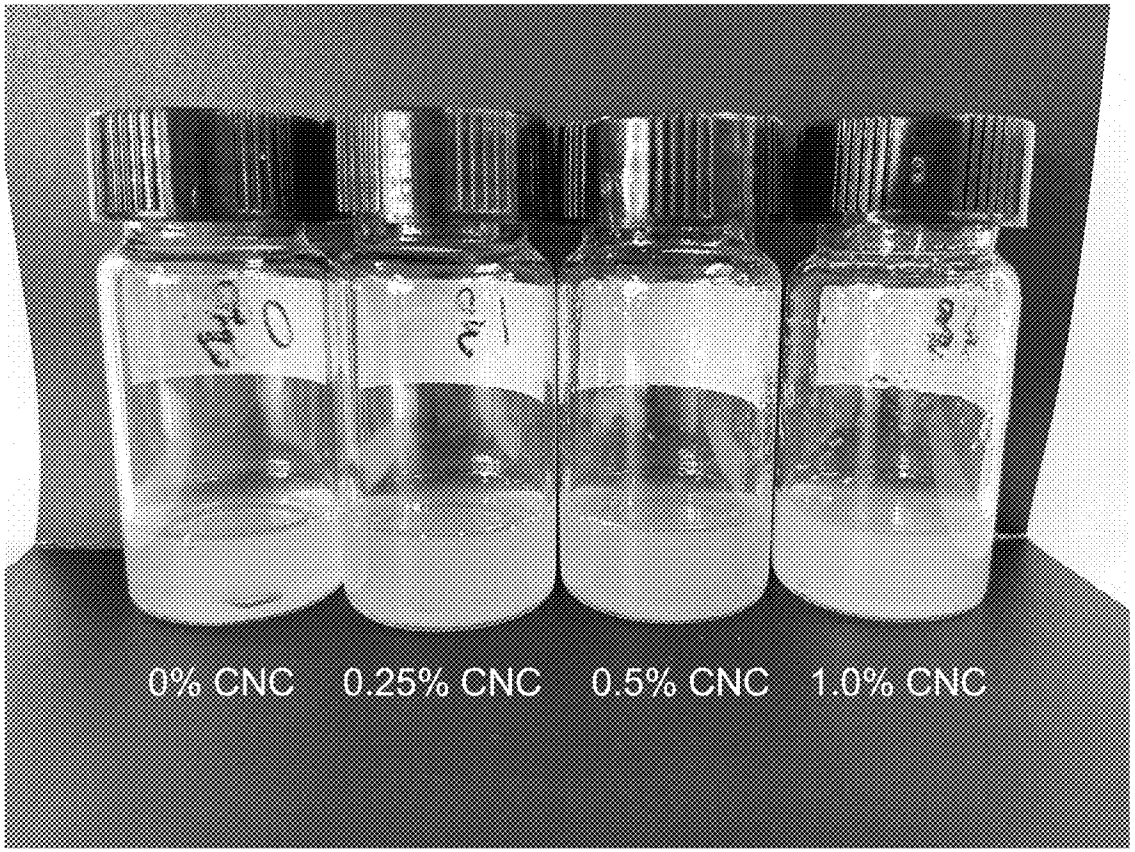
FIG. 4 shows the digital photographs of silk spinning dopes containing different CNC concentrations. From left to right: 0%, 0.25%, 0.5%, and 1.0% CNC. All the spinning dopes showed a clear appearance, and no sediment was observed after one week of storage. The spinning dope compositions were stable and spinnable after 1 month when stored at 4° C.

The reconstruction of the hierarchical architecture of silk fibroin requires the imposition of an anisotropic alignment of protofibrils during the fabrication process. Since LiBr dissolves the silk fibroin by breaking inter- and intramolecular hydrogen bonds without destroying the backbones of silk nanofibrils, it provides a significant prerequisite for the β-sheet folding and anisotropic alignment. In addition, seeding rod-like CNCs can promote crystallization and alignment because the negatively-charged CNCs (with sulfate groups) can be suspended evenly in the solution (FIG. 4), and with the silk fibroin also being negatively charged, the charge screening effect of these two negatively-charged species can promote protein-protein interaction and lead to better self-organization. In this regard, the silk fibrils were found to self-organize into a nematic crystal phase with the assistance of CNCs when subjected to shear stress and spatial constraint.

Figure 5B:
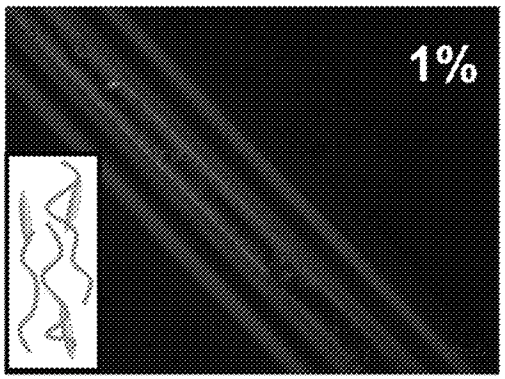
FIG. 5B shows the POM image of silk spinning dope with CNCs loaded in a glass capillary and observed under cross polarizers, showing birefringence. Inset is a graphical illustration of silk fibrils doped with CNCs that are suspended in the capillary.
Figure 5A:
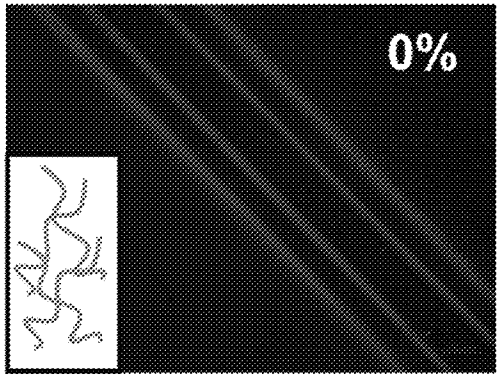
FIG. 5A shows the POM image of silk spinning dope loaded in a glass capillary and observed under cross polarizers. Inset is a graphical illustration of silk fibrils suspended in the capillary.
Figure 6:
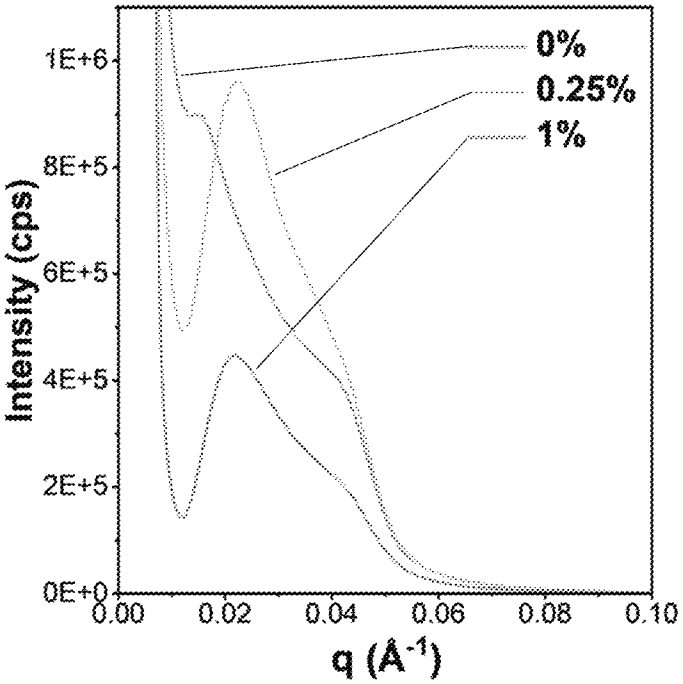
FIG. 6 shows the SAXS profiles of the scattering vector q for the silk spinning dopes inside a glass capillary (1.5 mm diameter), indicating a nematic phase.

The above was supported by observing the silk dope loaded in a glass capillary under a polarized optical microscope (POM) (FIGS. 5A and 5B). Silk dope with CNCs showed a bright light reflection at 45° to the cross polarizers (FIG. 5B), indicating an anisotropic and nematic alignment texture of the molecules, while no birefringence was observed in the silk dope without CNCs (FIG. 5A). This result was further supported by the anisotropic nature of the small angle X-ray scattering (SAXS) profiles obtained from samples of the silk solution prepared in a glass capillary (FIG. 6). The nematic arrangement of CNC-doped silk solution can be attributed to the shear stress generated during ejection into the capillary. The distance between silk fibrils can be determined from the lattice size d, which can be obtained from $2\pi/q$, where q is the scattering vector modulus at the intensity maximum of the reflection. The scattering intensity on the SAXS patterns reveals two broad peaks whose scattering vector moduli are in a ratio of 1:2. They correspond to a period of ~15.7 Å. Therefore, the addition of CNCs tightened the nematic arrangement in the silk fibrils, as indicated by the shift to a higher value of q.

Figure 7A:
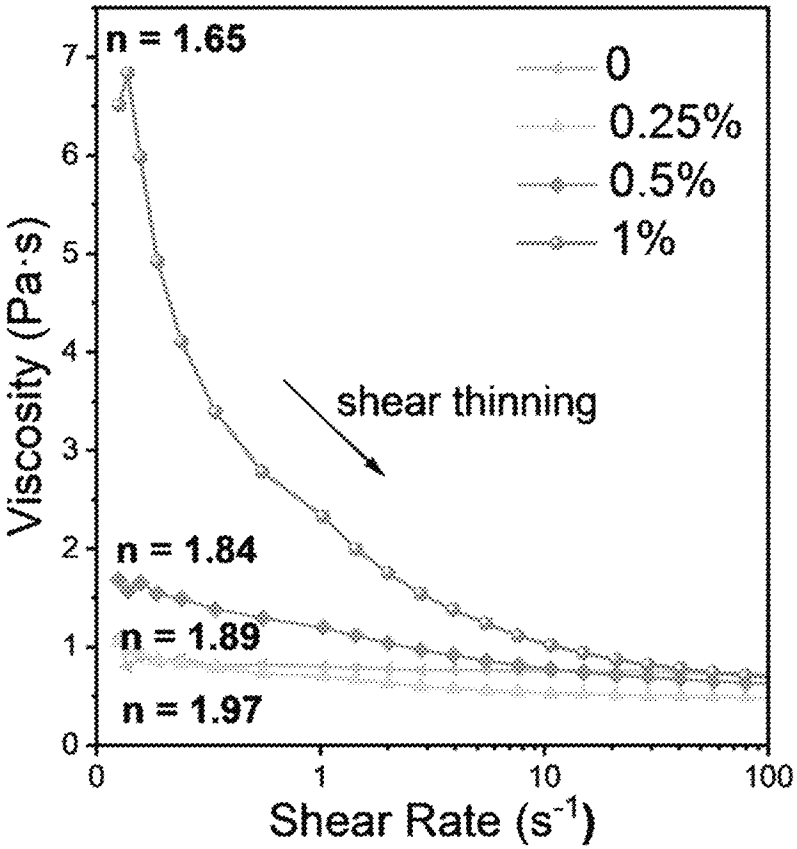
FIG. 7A shows the rheology measurements of the silk spinning dopes showing an increase in viscosity and shear-thinning behavior upon the increase in CNC concentration.
Figure 7B:
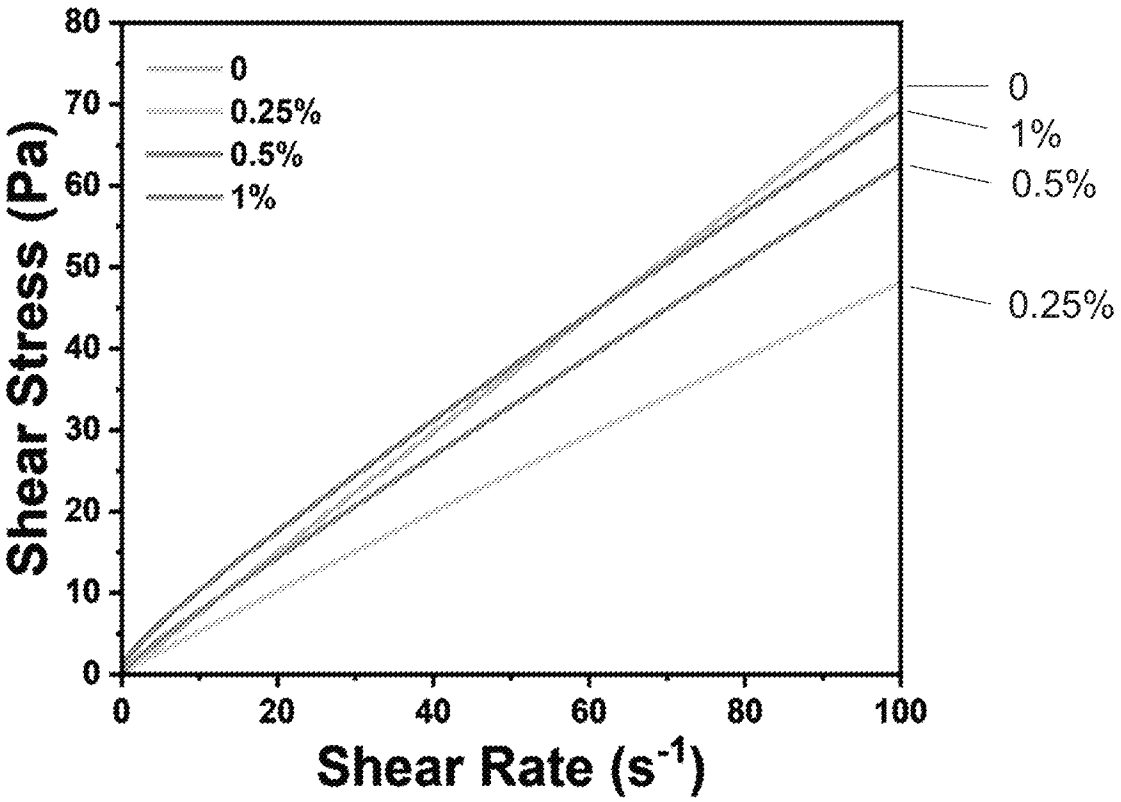
FIG. 7B shows the shear stress versus shear rate for the silk spinning dope containing different ratios of CNCs.

The tuning of silk protein nematic phase organization by CNCs dramatically affected the rheological properties of the silk dopes (FIGS. 7A and 7B), and suitable rheological properties are believed to be a critical factor in fiber spinning. The viscosity at a very low shear rate increased dramatically upon the increment of CNC concentrations, which led to a tighter arrangement of silk fibrils. Moreover, viscosity decreased abruptly with the increase in shear rate, indicating a pronounced shear-thinning behavior of the silk solution. Shear-thinning is usually considered synonymous with pseudo-plastic behavior that leads to favorable spinnability. After further analysis of the flow behavior and rheological properties by calculating the non-Newtonian exponent (n) from the shear stress and shear rate (FIG. 7B), the lower n value from the silk dope with CNCs signified a higher molecular chain interaction and better spinnability.

Example 4

Morphological and Anisotropic Analysis of the Silk Fibers

It is believed that the alignment of the silk fibrils and CNCs along the fiber axial direction is crucial to ensure high mechanical strength and shape fixity of the fibers. When the molecular segments are aligned parallel to the fiber longitudinal vector, the tension will result in the uncoiling of the α-helix and random coil, thereby resulting in a higher strain. In this regard, it is believed that a CNC-decorated silk solution that shows nematic organization is ideal for the fabrication of hierarchical water-responsive silk fibers.

Figure 8:
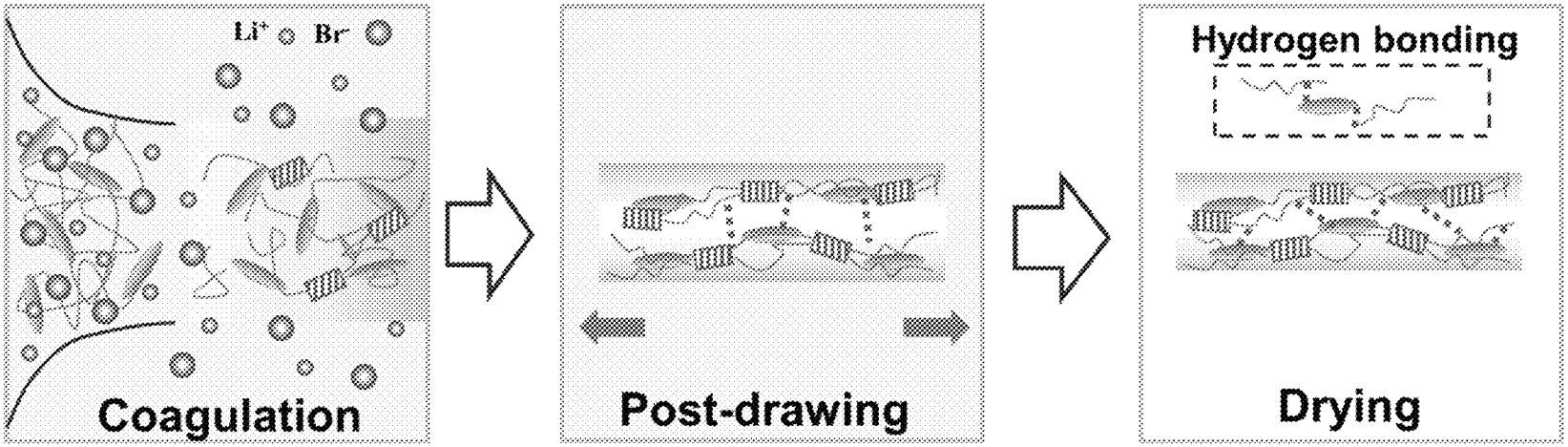
FIG. 8 is a schematic diagram illustrating the wet-spinning process for preparing the regenerated silk fibers in accordance with the embodiments of the invention.
Figure 9B:
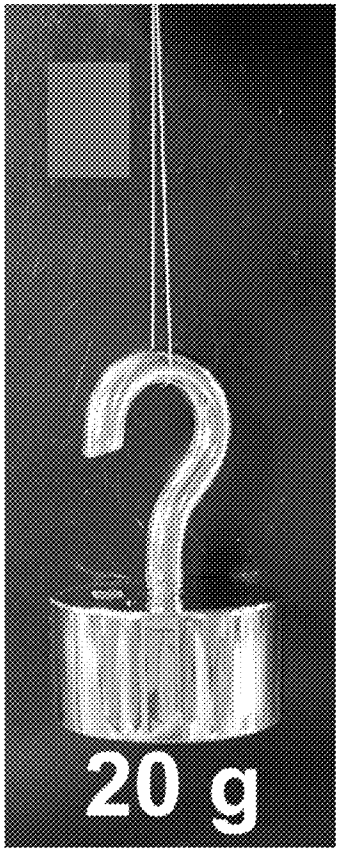
FIG. 9B shows the digital photo of a regenerated silk fiber in accordance with an embodiment of the invention lifting 20 g weight.
Figure 9A:
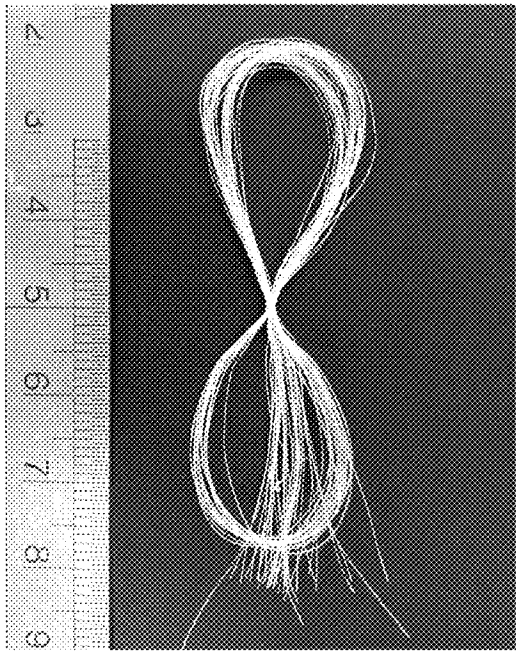
FIG. 9A shows the digital photograph of a bundle of homogenous regenerated silk fibers in accordance with an embodiment of the invention.

In this work, the anisotropic silk fibers were produced by wet-spinning methods that include extrusion and drawing processes, using ammonium sulfate ($(NH_4)_2SO_4$) aqueous solution as the coagulation bath to sediment the silk fibers. As illustrated in FIG. 8, LiBr is allowed to diffuse into the coagulation bath, and the silk fibrils can gradually assemble into a compact nematic organization. The alignment of the fibrils to the fiber axis and β-sheet formation was further enhanced by a post-drawing approach in the coagulation bath. Due to the intrinsic high content of repeating glycine, alanine, and serine sequences, the silk fibrils may be able to self-fold into β-sheets and be fixed by intra-chain hydrogen bonds after drying. The hydrogen-groups-rich CNCs were embedded in the silk fiber through hydrogen bond linking. As such, continuous and homogenous silk fibers were yielded, and are flexible and can be wrapped into a bundle (FIG. 9A) and are strong enough to lift a 20 g weight (FIG. 9B).

Figure 10:
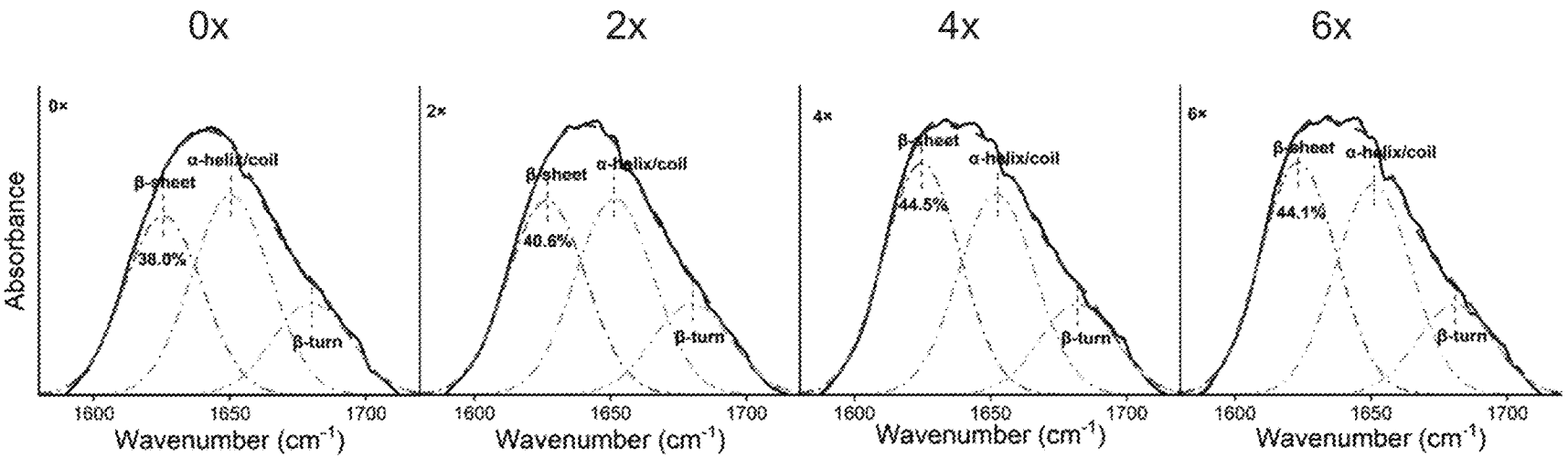
FIG. 10 shows the peak deconvolution analysis from amide I region (1600-1700 $cm^{-1}$) in FTIR spectra of the regenerated silk fibers with different post-drawing ratios.
Figure 11:
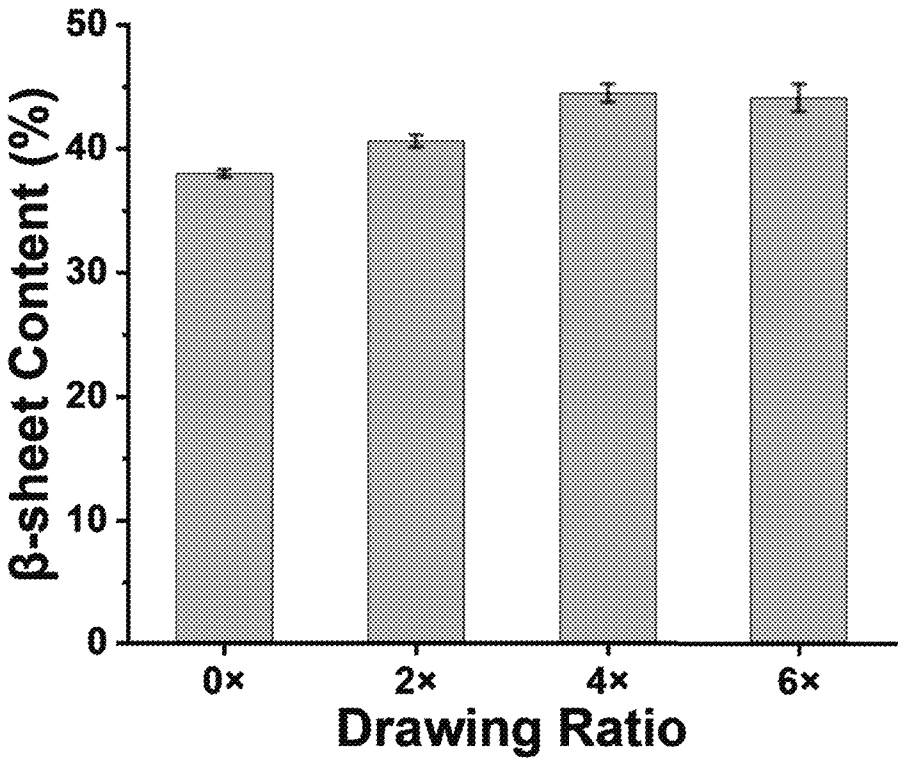
FIG. 11 shows the β-sheet contents of regenerated silk fibers with different post-drawing ratios. The values were calculated from peak deconvolution analysis on amide I signal in FTIR spectra of FIG. 10.

Post-drawing in a coagulation bath for the raw sedimented fiber can induce the alignment of protein molecules and confer significantly robust mechanical properties and anisotropy. After drawing, the peptides are easier to self-fold into β-sheets and generate crystallites in the fibers. This is confirmed by Fourier-transform infrared spectroscopy (FTIR), through the peak shifting from 1650 $cm^{-1}$ to 1620 $cm^{-1}$ in the amide I region, indicating a transformation from α-helices to β-sheets (FIGS. 10 and 11).

Figure 12:
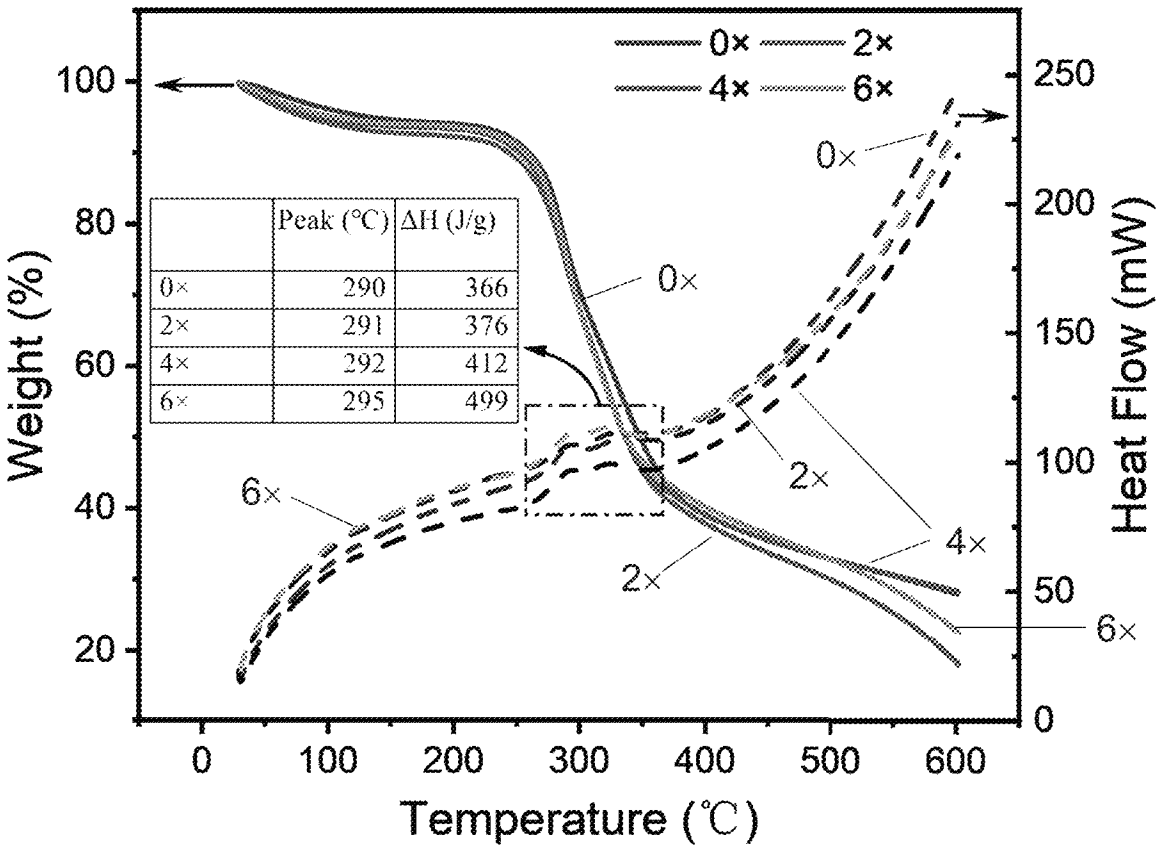
FIG. 12 shows the thermogravimetric analysis (TGA) and differential scanning calorimetry (DSC) plots of regenerated silk fibers with different post-drawing ratios
Figure 13:
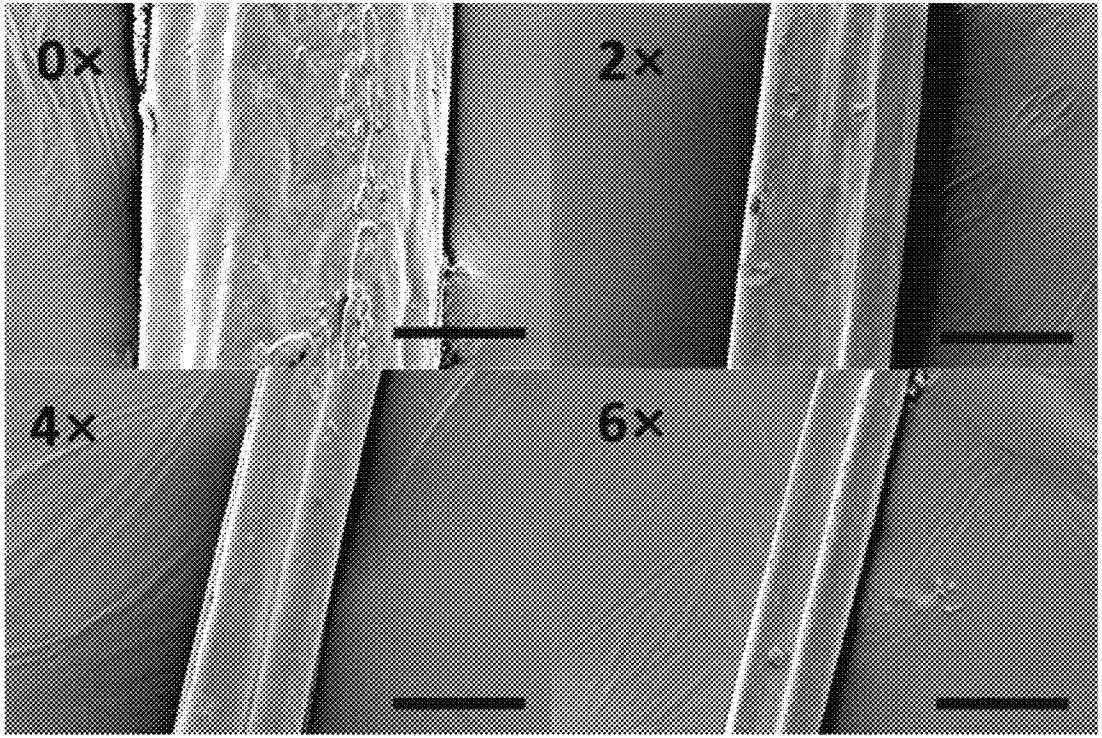
FIG. 13 shows the SEM images of the regenerated fibers fabricated with different drawing ratios. Fibers became thinner with each increment of drawing ratios, scale bar: 100 μm.

It is believed that in the silk-based fibers, the crystalline regions are composed of several adjacent β-sheets from different molecules. The melting enthalpy obtained from the differential scanning calorimetry (DSC) demonstrated the increment in crystallinity and further supported the formation of β-sheets (FIG. 12). Thus, the post-drawing treatment resulted in both thinner fibers (FIG. 13) and yielded fibers with higher crystallinity and better tensile properties.

Figure 14B:
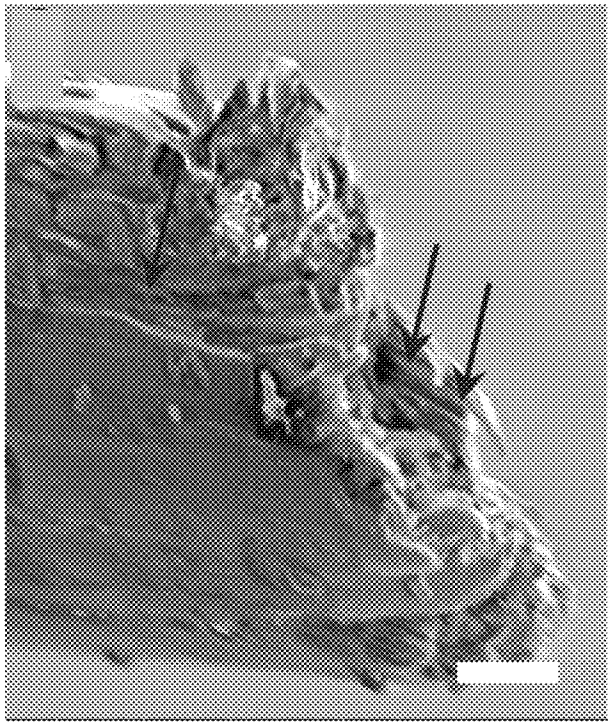
FIG. 14B shows the SEM image of fiber cross-section, where aligned nanofibrils are indicated by arrows, scale bar: 10 μm.
Figure 14A:
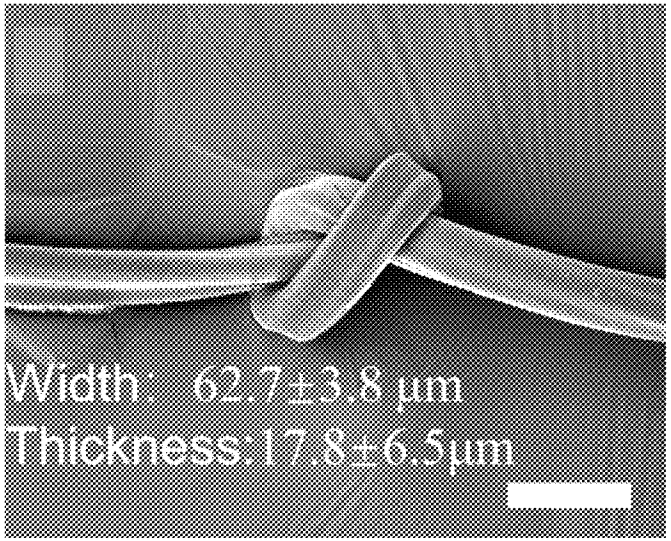
FIG. 14A shows the SEM image of a knotted regenerated silk fiber, demonstrating the flexibility, scale bar: 100 μm.
Figure 15:
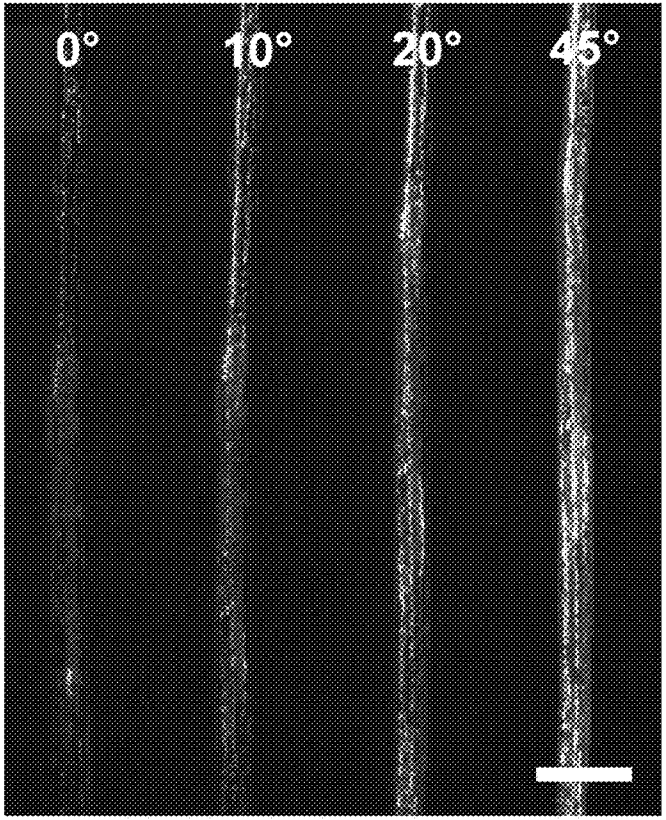
FIG. 15 shows the POM image of a single fiber observed under cross polarizers, showing the anisotropic birefringence, scale bar: 200 pixels.
Figure 16:
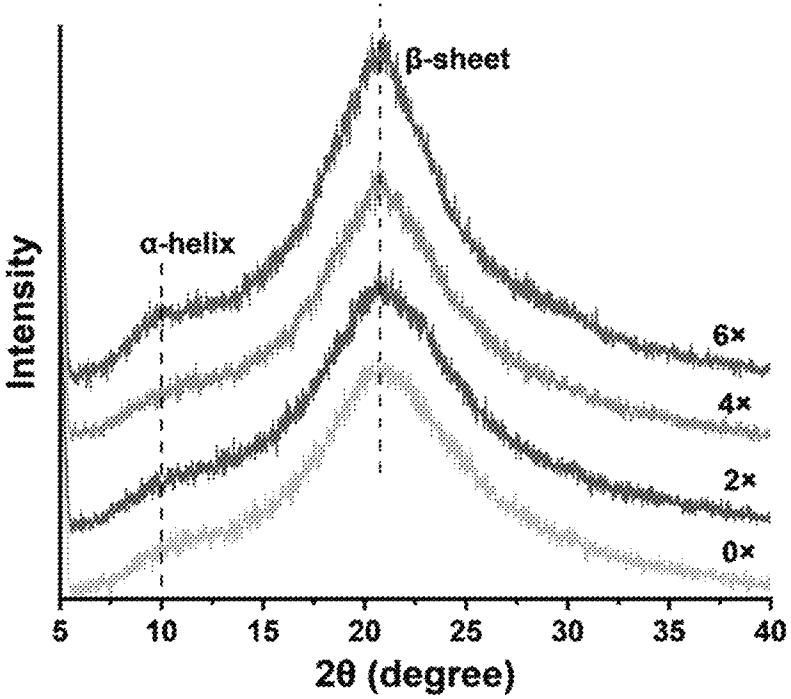
FIG. 16 shows the WXRD scattering profile of a bundle of regenerated silk fibers with different post-drawing ratios.

The nematic organization and post-alignment of the silk protofibrils led to a fibrillation process and generated a hierarchical and anisotropic fiber structure. The optimized silk fibers possessed a smooth surface when observed under the scanning electronic microscope (SEM, FIG. 14A), and the hierarchical structure can be observed from the cross-section, which showed silk fibrils stacked compactly and aligned parallel to the fiber axis (FIG. 14B). The as-made silk fibers exhibited flat-ribbon-like shapes and possessed an average width of 62.7±3.8 μm and an average thickness of 17.8±6.5 μm. The POM image of a single silk fiber observed using the cross polarizers further testified to the anisotropic nature of the silk fibers by showing the birefringence behavior with transmitted light increased by rotation from 0° and reached its maximum at 45° (FIG. 15). Patterns obtained from WXRD (FIG. 16) supported the fibril alignment and compact structure by showing a narrower FWHM for the peak around 20.9° with an increase in drawing ratio, showing a higher compactness of the β-sheet conformation in the silk fibers. Meanwhile, the peak at 10°, representing the α-helix structure, also became more intense, confirming the increase of structural alignment in the fibers.

Example 5

Hydration-Responsive Shape-Memory Effect

Figure 17:
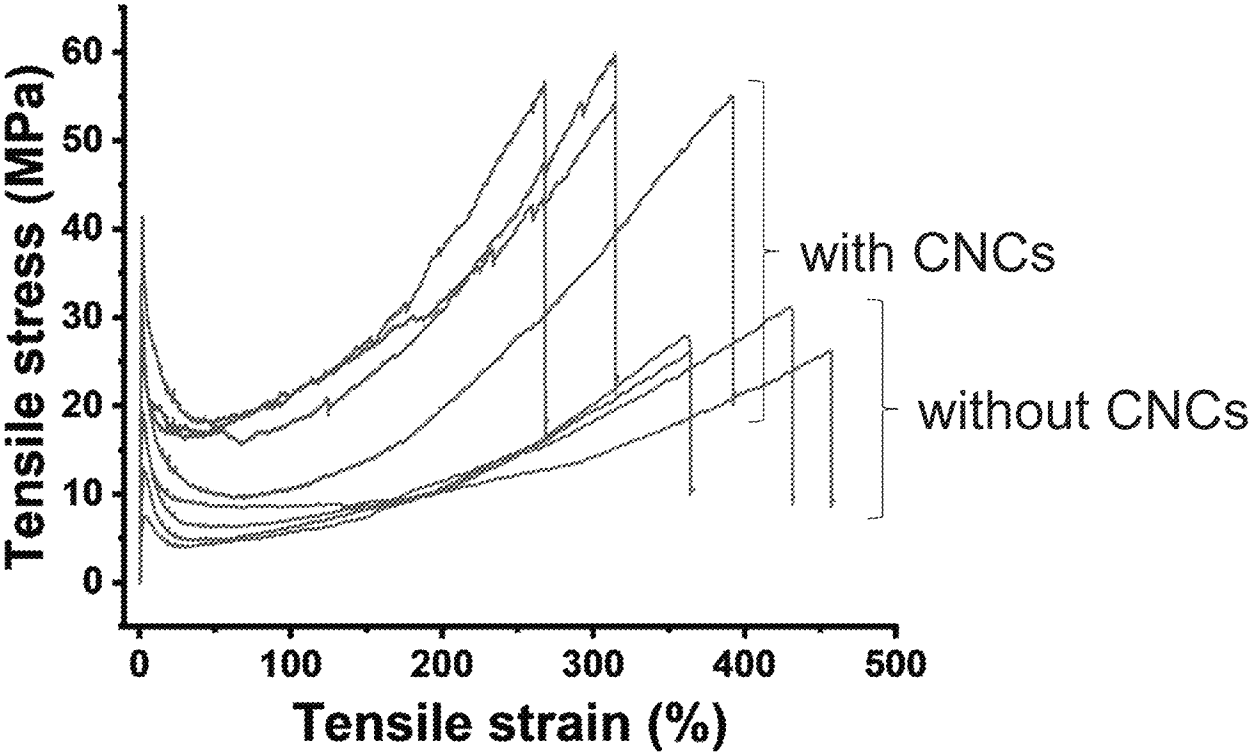
FIG. 17 shows the strain-stress curves comparison from regenerated silk fibers without and with 1% CNCs. It is shown that the tensile stress is improved significantly with the addition of CNCs.

It is believed that adequate mechanical properties are important in enabling the fibers to be used in shape-memory programming and engineering processing. It is also believed that owing to the high crystallinity and rich hydroxyl groups on the surface of CNCs, the addition of CNCs stabilized the networks in silk fibers and thus improved the tensile strength through physical enhancement and hydrogen bond bridging (FIG. 17).

Figure 18:
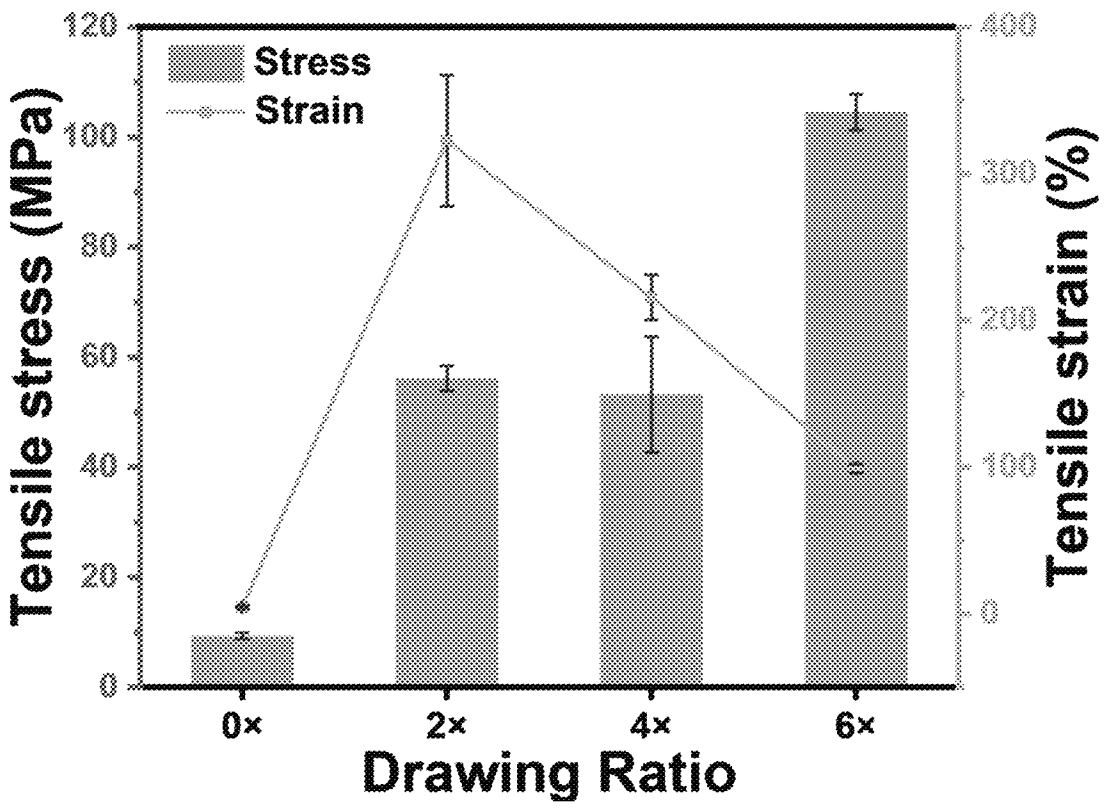
FIG. 18 shows the ultimate tensile stress and strain of regenerated silk fibers with different post-drawing ratios (specimen N=3, the error bar presents the standard deviation)
Figure 19A:
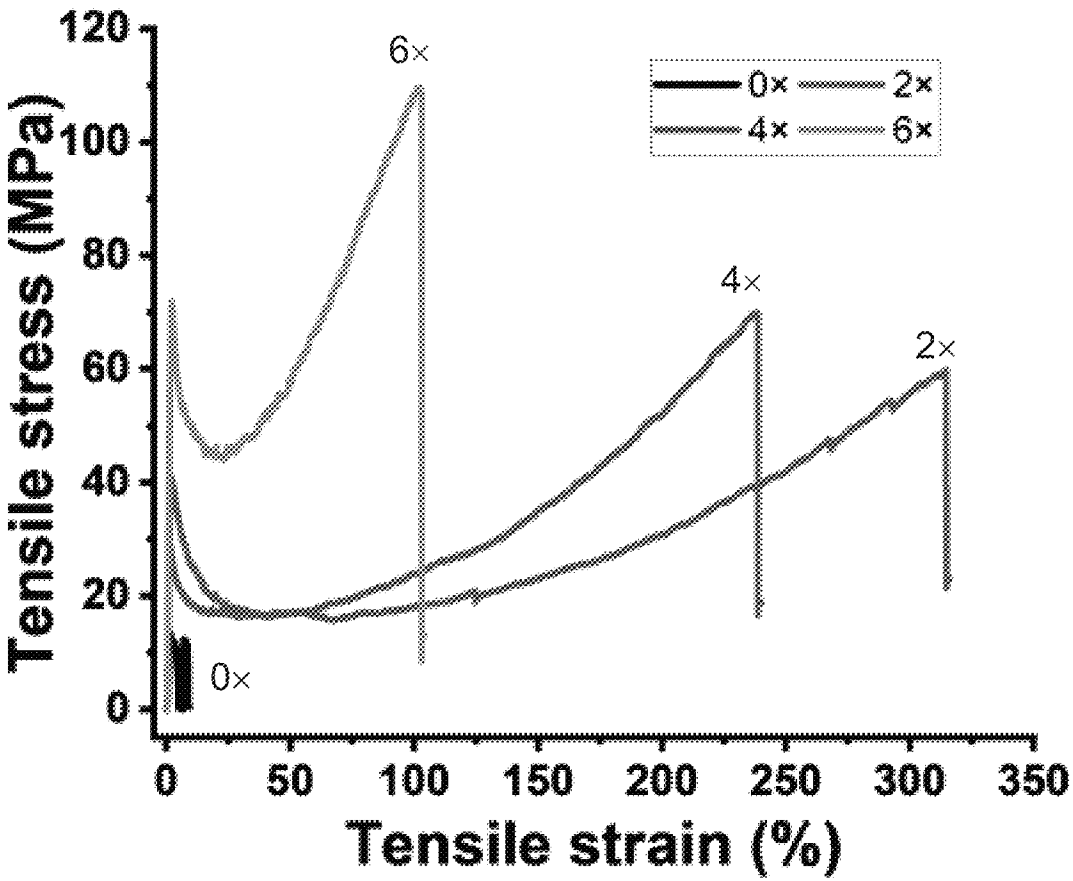
FIG. 19A shows the strain-stress curves of the regenerated silk fiber under dry conditions.
Figure 19B:
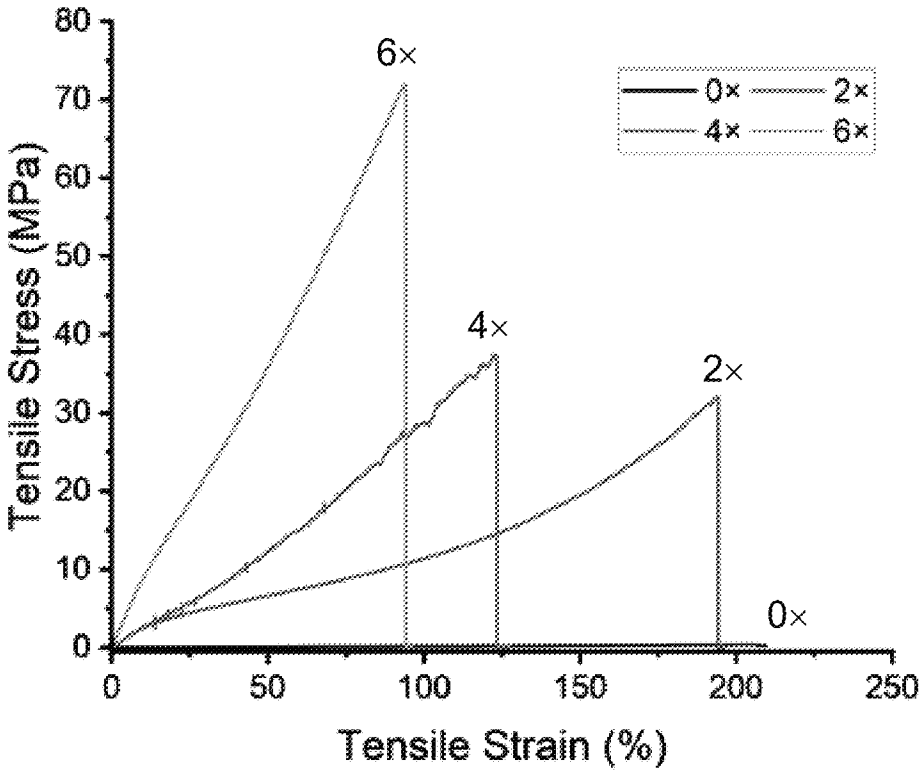
FIG. 19B shows the strain-stress curves of the regenerated silk fiber under wet conditions.
Figure 19C:
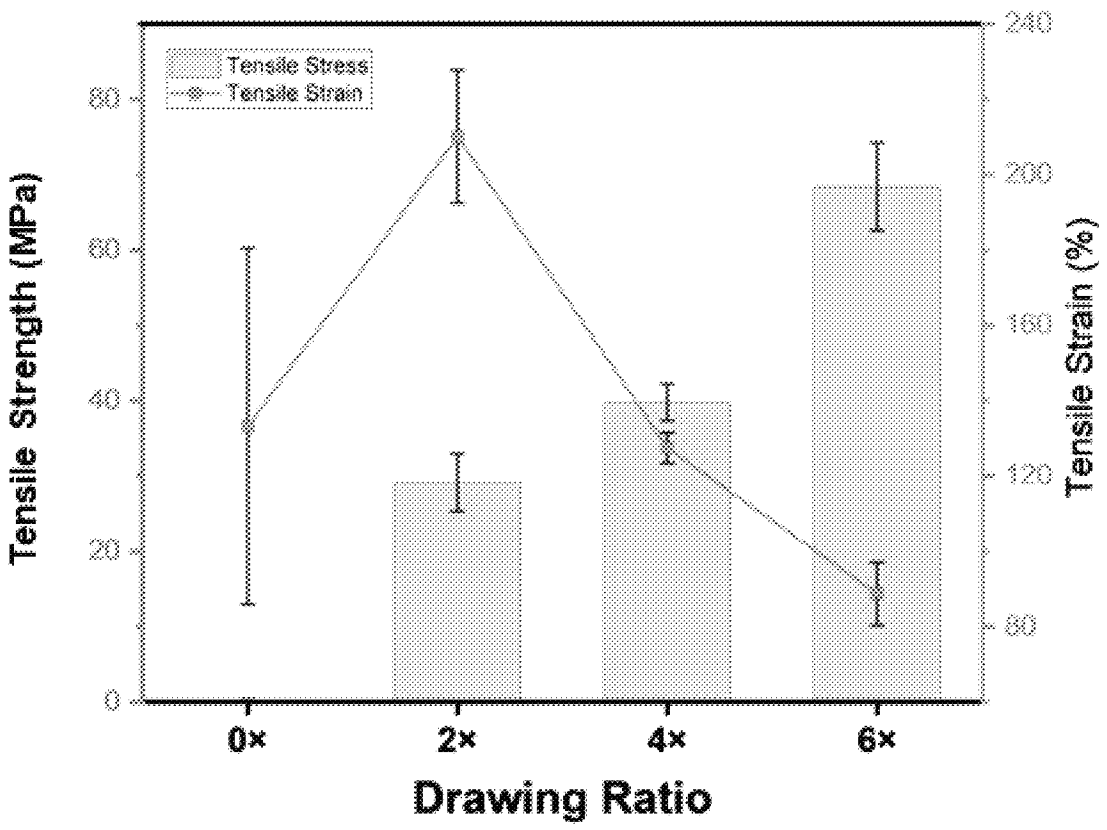
FIG. 19C shows the summary of the mechanical properties of the regenerated silk fiber under wet conditions. The wet mechanical properties of the drawn fibers show only a slight decrease after wetting, demonstrating the compact structure that is resistant to water disruption.
Figure 20:
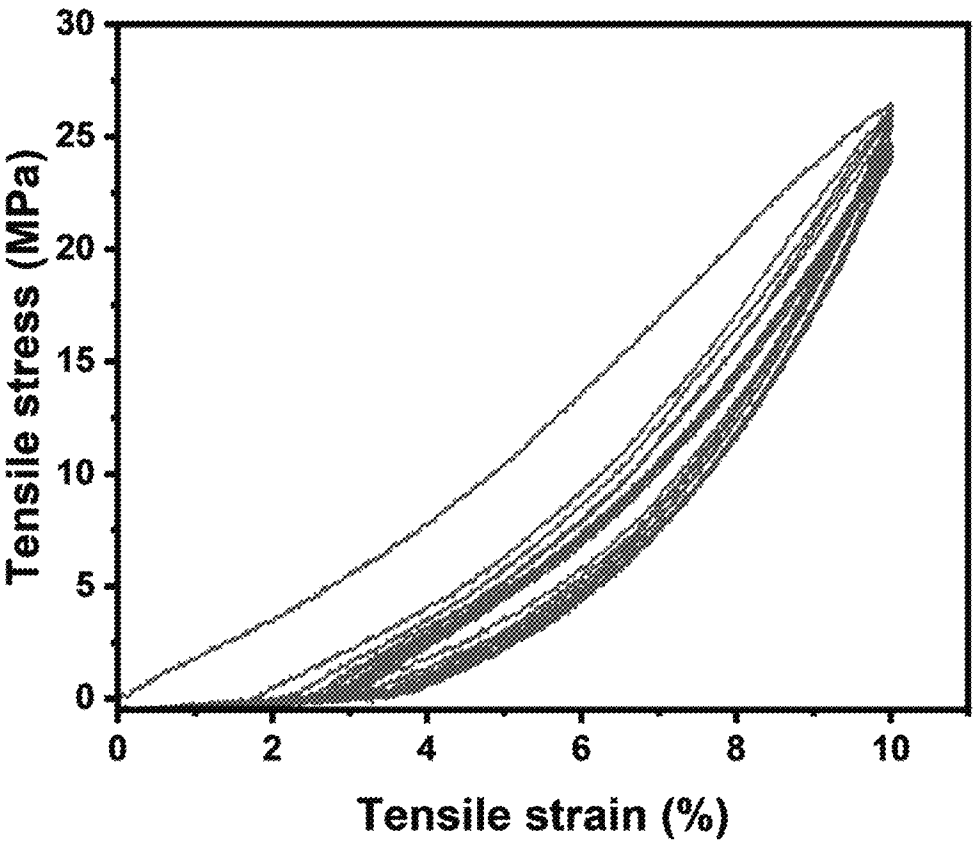
FIG. 20 shows the cyclic test of a single regenerated silk fiber in the wet state. The small hysteresis indicates the wet stability and durability of the fiber.

Although the addition of CNCs partially sacrificed extensibility, a higher tensile strength enabled the silk to withstand the stress created during the processing of the subsequent products. In addition, the alignment of the protein protofibrils parallel to the fiber axis and the crystallite formation induced in the post-drawing contributed to the high tensile strength, which can reach 104.5±3.3 MPa (a single fiber can withstand ~16 cN force) at a fracture strain of 99±3%. Moreover, the toughness was determined to be 64.6±3.3 MJ/m$^3$ (FIG. 18). As it is evaluated in the above section, the regenerated silk fibers possessed high crystallinity and a compact hierarchical structure, which can reduce water adsorption and guarantee water stability. The regenerated silk fibers showed a standard moisture regain of 10% and a tensile strength of 68.4±5.8 MPa at 89±8% strain after hydration (FIGS. 19A-19C). Moreover, the wet cyclic test (FIG. 20) indicated the durability of the fibers. It is believed that owing to the well-established long-range hierarchical fibril silk structure, the mechanical properties thereof could meet the engineering needs of the textile industry and perform better than other protein-based shape-memory materials.

Figure 21:
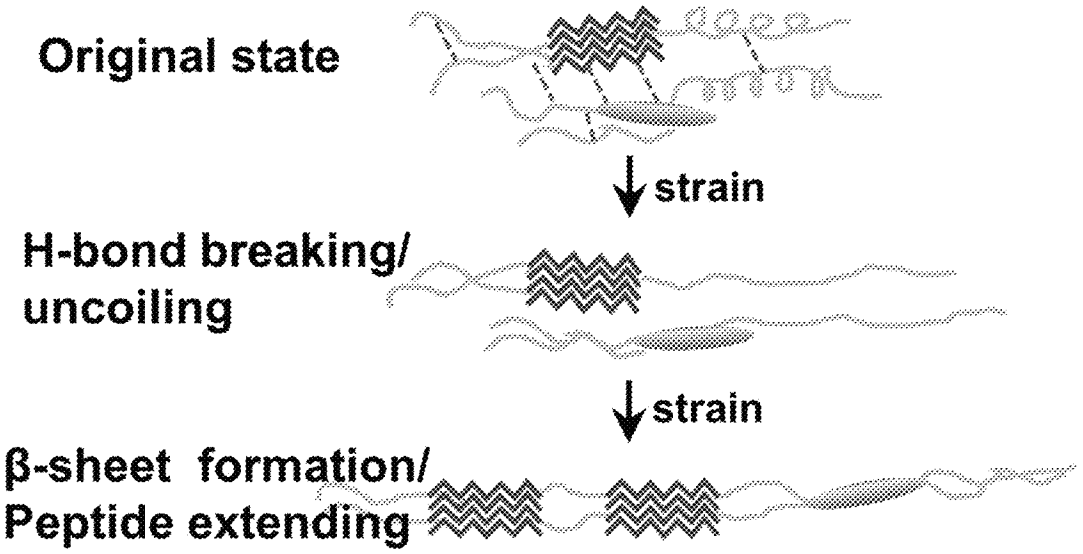
FIG. 21 is a schematic diagram illustrating the silk fiber secondary structure transformation from the α-helices/random coils to β-sheets under axial strain.
Figure 22:
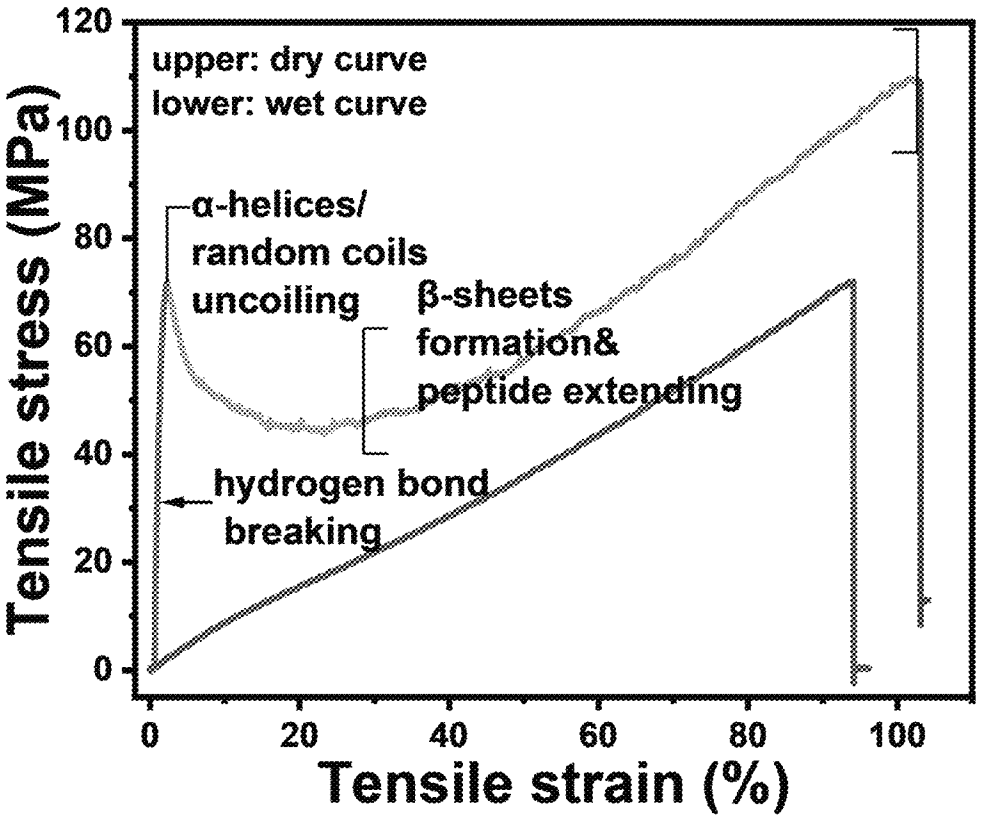
FIG. 22 shows the representative strain-stress curves (from N=3) of regenerated silk fibers (1% CNC, 6×) under dry and wet conditions.

It is believed that in shape-memory protein fibers, the shape-memory effect relies on the reversible transformation from α-helix/random coils to β-sheets when an axial external load is applied (FIG. 21). This mechanism was confirmed by analyzing the strain-stress curves from a single silk fiber, which showed an initial elastic response up to ~2% strain (a Young's Modulus of 3.6±0.1 GPa) followed by relaxation and strain hardening behavior (FIG. 22).

The initial elastic behavior is associated with the hydrogen bond breaking in α-helices, random coils, and silk fibrils-CNCs, while the relaxation period is the result of the α-helices and random coils uncoiling. The strain hardening originates from the formation of new β-sheets and peptide uncoiling. This unique mechanical behavior shows different viscoelastic phenomena in the three different stages of the tensile test, which is related to the hierarchical structure of the regenerated silk fibers. Differently, the tensile curve of a wet silk fiber showed a gradual transition between the elastic and yielding regions when subjected to increasing strain, which can be attributed to the destruction of hydrogen bonds in amorphous regions during hydration. The near-linear behavior observed from the wet strain-stress curve further supported the good alignment of silk fibrils relative to the fiber axis.

Figure 23A:
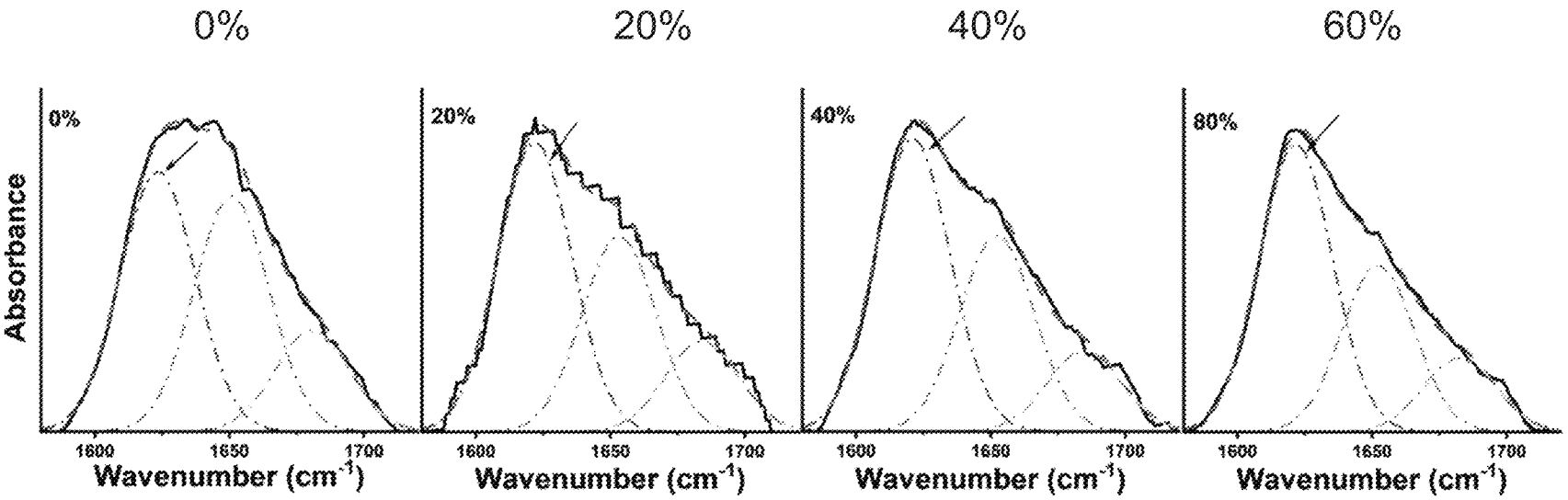
FIG. 23A shows the peak deconvolution analysis of amide I region from 1600-1700 $cm^{-1}$ on FTIR spectra of the regenerated silk fibers under different strains, showing the increasing of β-sheet content with the increment of strain. Black arrows indicate the β-sheet.

The rearrangement of the protein secondary structure from α-helices to β-sheets during the continuous straining process was monitored from the shifts in the amide I region in the FTIR spectrum between 1600 cm$^{-1}$-1700 cm$^{-1}$. FIGS. 23A and 23B show the peak deconvolution presenting more intense absorbance at 1620 cm$^{-1}$ (representing β-sheets) and a weaker signal at 1650 cm$^{-1}$ (presenting α-helix/random coils). This result indicated a slight increase in the β-sheets and uncoiling of the α-helices after straining, which has been observable in spider dragline silk.

Figure 24:
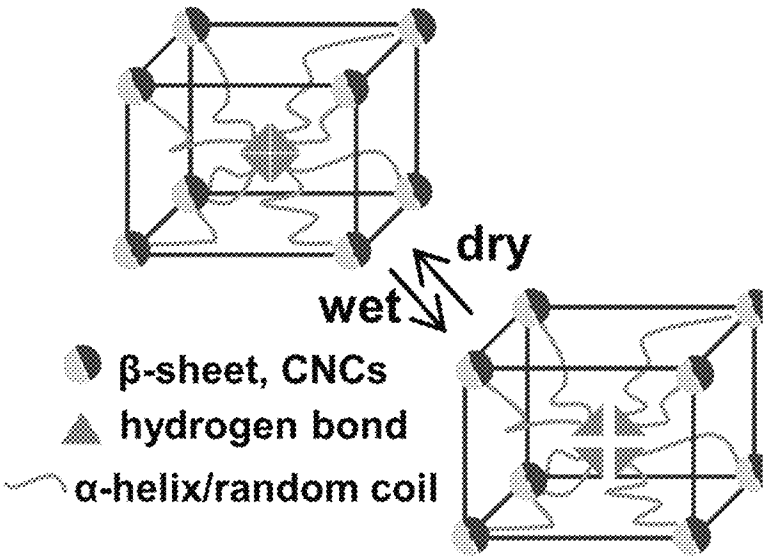
FIG. 24 is a schematic diagram illustrating the "net-point" model which illustrates the hydration-responsive shape-memory effect in silk fibers.
Figure 25B:
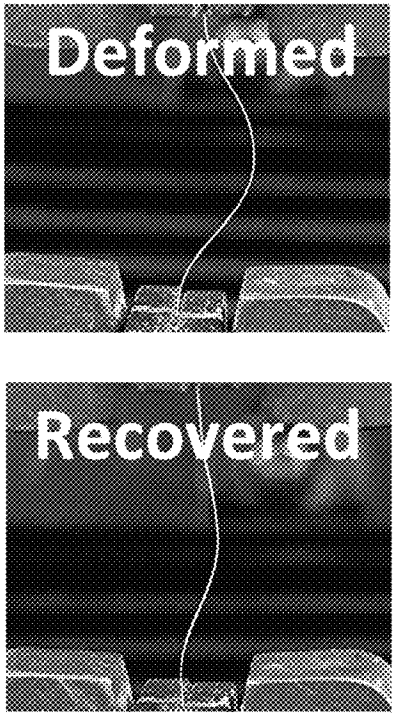
FIG. 25B shows the photographs of the programmed state and recovered state of a silk fiber.
Figure 25A:
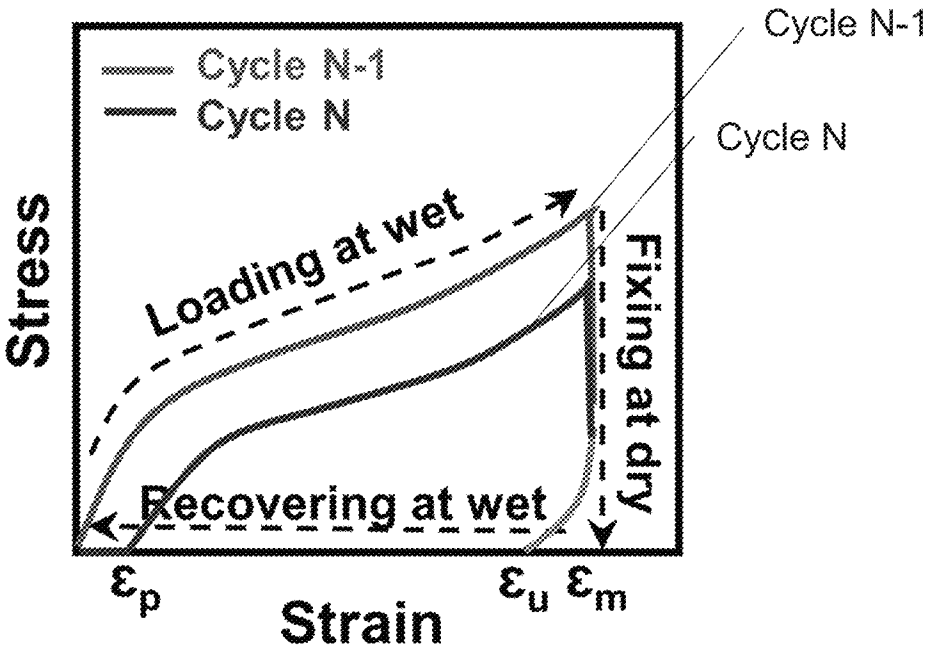
FIG. 25A shows the representative shape-memory programming cycle plot for the shape fixity and shape recovery rate calculation.

It is believed that the shape-memory effect requires reversible chemical bonds as switches and crystalline regions as net points to stabilize the network (FIG. 24). The semi-crystalline structure of silk fibers can fit these criteria, as β-sheet and CNCs are assigned as net points, hydrogen bonds are assigned as switches, and α-helix/random coils are assigned as the springs. Herein, we conducted shape-memory programming cycle tests by applying strain to the fiber axis to testify to the water-actuated shape-memory effect in the regenerated silk fibers. A typical shape-memory cycle contains three critical steps: stretching under wet conditions, fixing under dry conditions, and recovering under wet conditions (FIGS. 25A and 25B). The former two steps are known as the shape programming process. The shape-memory fixity (Rf, the ability of a material to memorize the temporary shape) and shape-memory recovery rate (Rr, the ability of a material to return to its original shape) can be determined from the strain-stress plots obtained in the shape-memory programming cycles. They are determined using the following equations:

$$R_f = \frac{\varepsilon_u(N)}{\varepsilon_m} \times 100 \tag{1}$$

$$R_r = \frac{\varepsilon_m - \varepsilon_p(N)}{\varepsilon_m - \varepsilon_p(N-1)} \times 100, \tag{2}$$

where $\varepsilon_m$ is the maximum strain, $\varepsilon_u$ is the fixed strain after offloading, and $\varepsilon_p$ is the residual strain after recovery in wet air.

Figure 26:
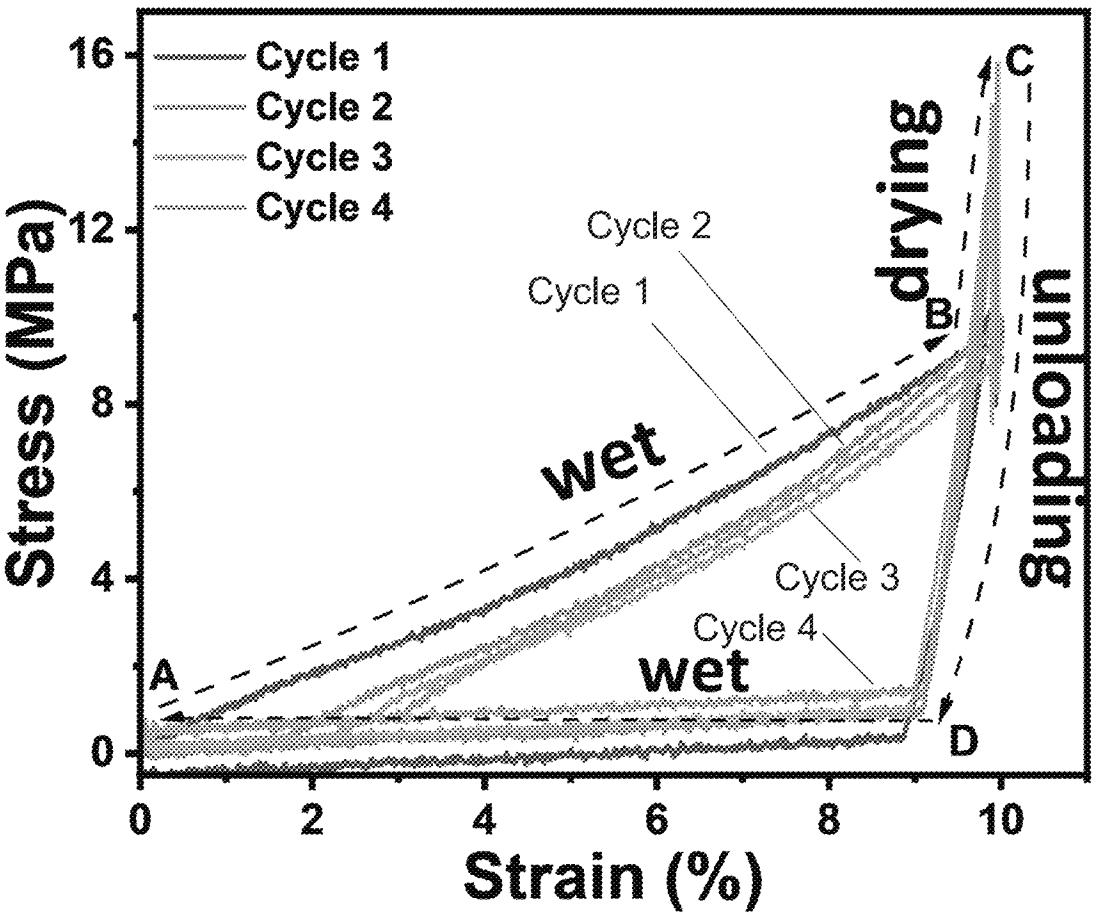
FIG. 26 shows the representative strain-stress plot of a single regenerated silk fiber that undergoes multiple water-actuated shape-memory programming and recovery cycles.

The water-triggered shape-memory effect of the silk fibers can be read from the programming cycles in FIG. 26. Elastic behavior was observed in the wet stretching process, and during the drying with tension, stress underwent a significant increase. The length of the silk fiber returned partially to the original state after rehydration.

Figure 27:
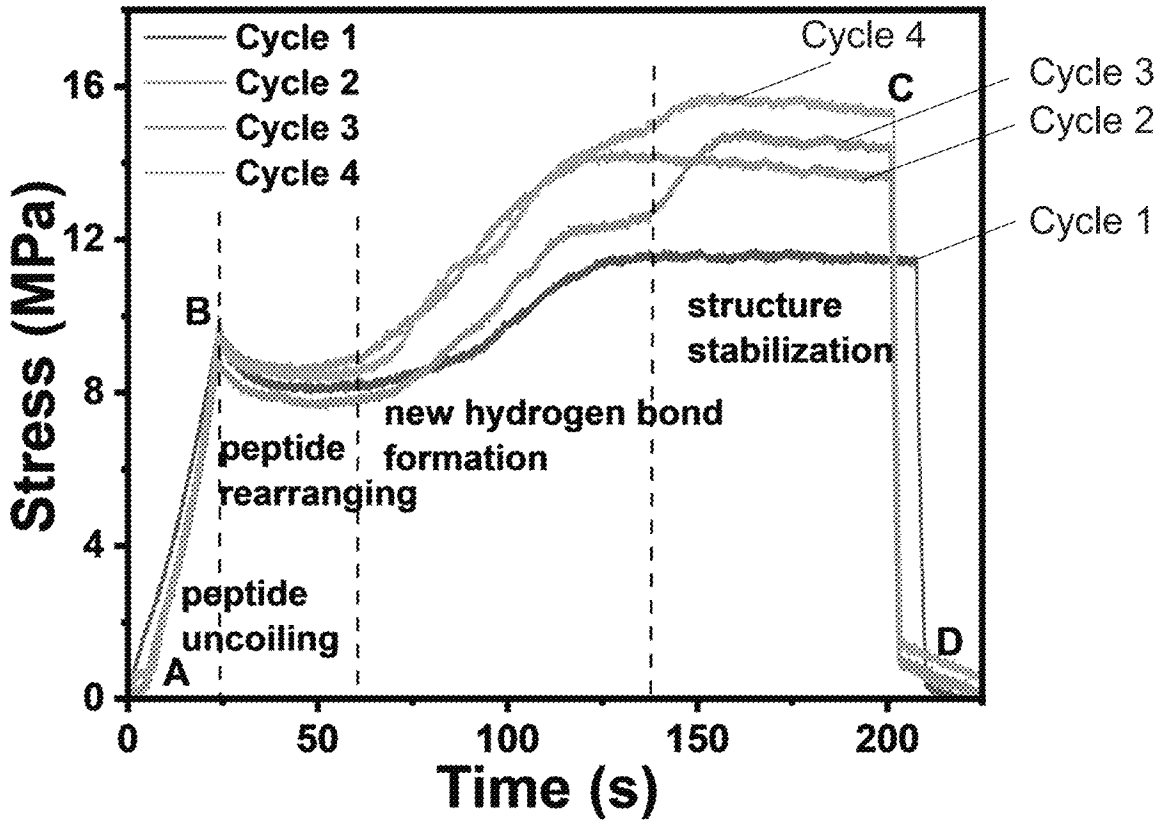
FIG. 27 shows the time-stress plots of the full programming and recovery cycles corresponding to FIG. 25B.
Figure 28:
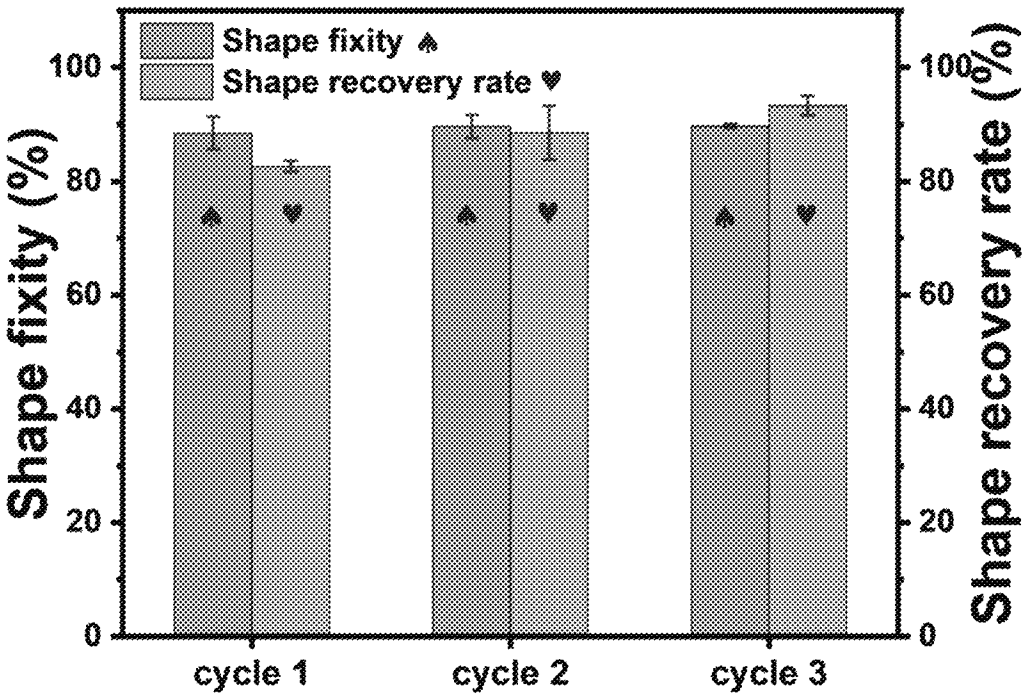
FIG. 28 shows the shape fixity and shape recovery rate determined from the strain-stress plot illustrated in FIG. 26. Mean values were obtained from N=3, and the error bar presents the standard deviation
Figure 29A:
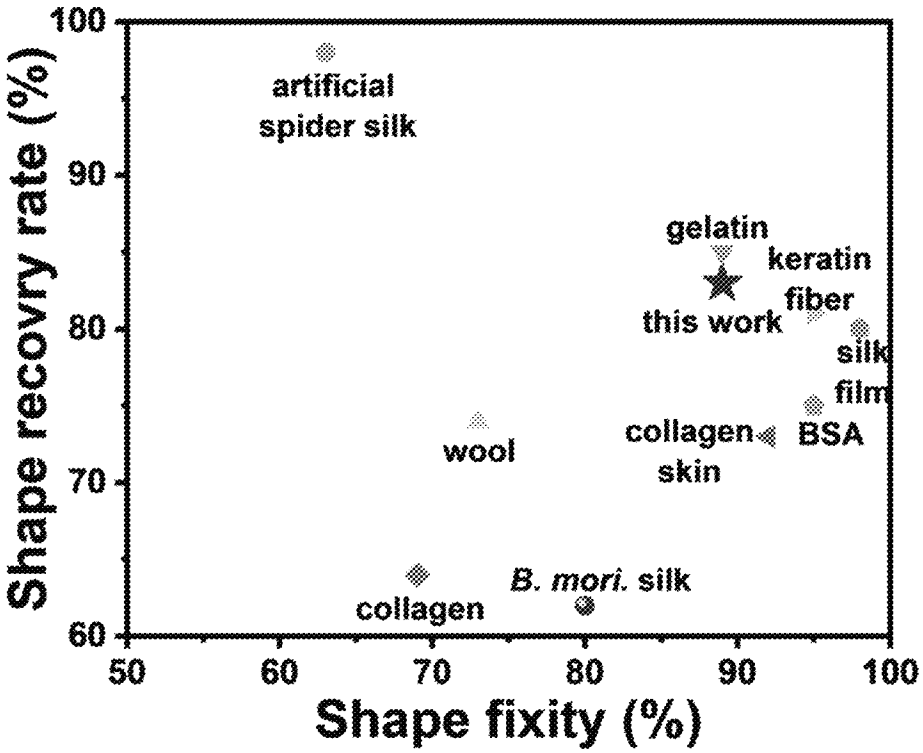
FIG. 29A shows the comparison of the shape-memory performance of the regenerated silk fibers in this work and other reported protein-based shape-memory materials.

The protein conformation transition that occurred during the shape-memory process can be analyzed in the time-stress plots shown in FIG. 27. A noticeable increase during drying may result from the new hydrogen bonds and β-sheet formation, which may be the result of the partial loss of the shape recovery rate. In the shape-memory programming cycles, the silk fibers can retain most of their length after release, yielding a shape fixity of ~90%. After rehydration, the recovery efficiency of the fibers reached a value of 82.7±0.9%. Because of the compact hierarchical fiber structure, the shape-memory performance is stable during the cycle tests (FIG. 28) and is comparable to other protein-based shape-memory materials (FIGS. 29A and 29B).

Figure 30:
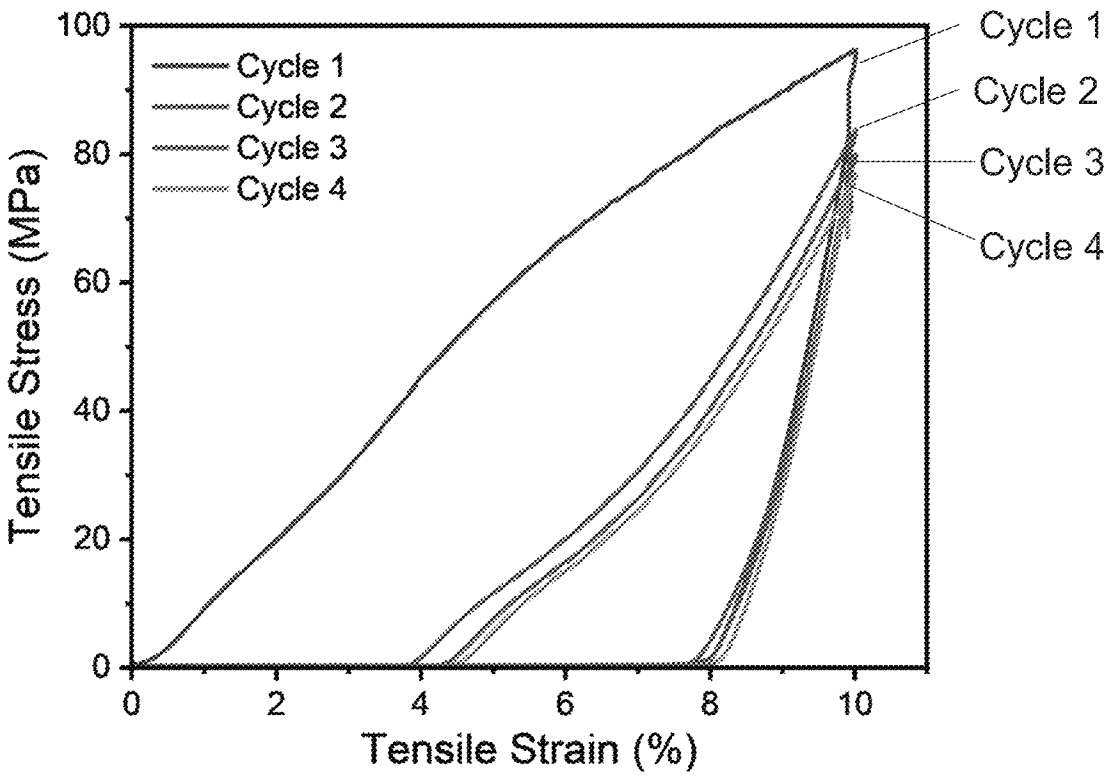
FIG. 30 shows the water-triggered shape-memory programming curves of cocoon silk, demonstrating that the natural silks possess poor shape-memory properties.

As a control, the hydration-induced shape memory performance of natural silkworm silk was also tested, and it resulted in a shape recovery rate of only ~60% (FIG. 30), while it is noticeable that no shape-memory effect has been observed in degummed silk because of the hydrophobicity after degumming. Apart from the stretching, it is believed that the regenerated silk fibers can be programmed to meet different desired needs, such as bending into loops and twisting into spirals. The anisotropic organization and semi-crystalline structure of the silk fibrils conferred such mechanical properties and shape memory effects that enable the possibility of their use in textile applications such as smart wound healing.

Example 6

Water-Driven Cyclic Response and Textile Applications

In addition to the water-triggered shape recovery, water-driven cyclic response has also been observed in the regenerated silk fibers. In contrast to the one-time contraction upon wetting in the shape-memory recovery, the water-driven cyclic response is a repeatable behavior of humidification relaxation and drying contraction. This cyclic contraction and relaxation in response to many cycles of humidity is an attractive behavior for various applications, including thermal management.

Figure 31A:
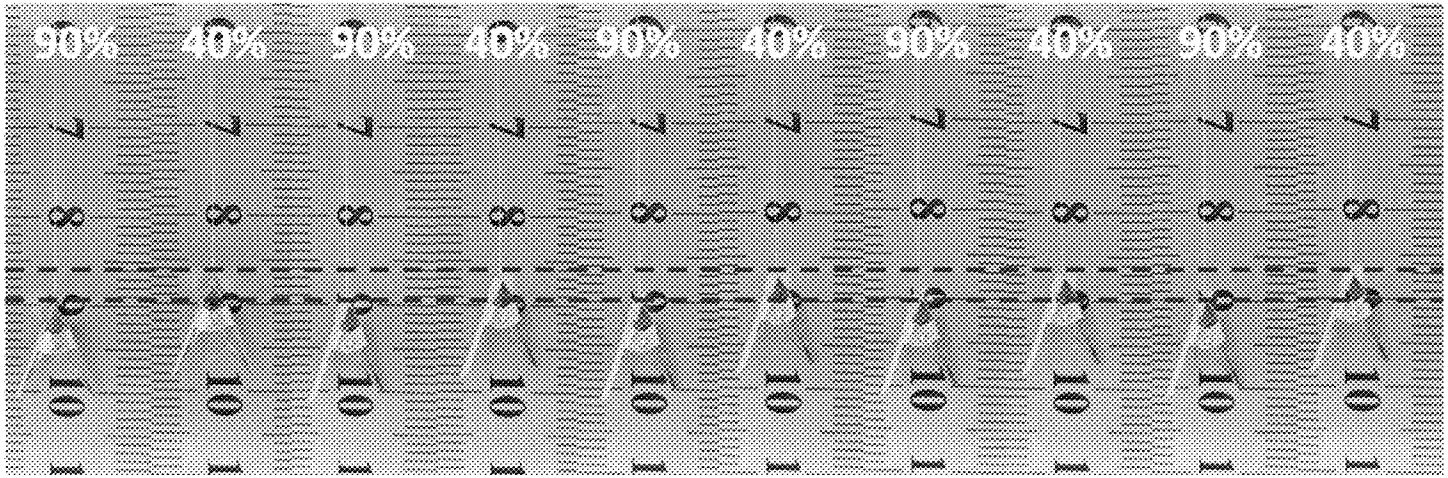
FIG. 31A shows an 8-cm long single 45 μm regenerated silk fiber lifting a 100 mg metal clip during repeated cycles of wetting and drying. The relative humidity is indicated in each frame. The average displacement is 2 mm (2.5%) in the first cycle and 3 mm (3.75%) in the following repeating cycles.
Figure 31B:
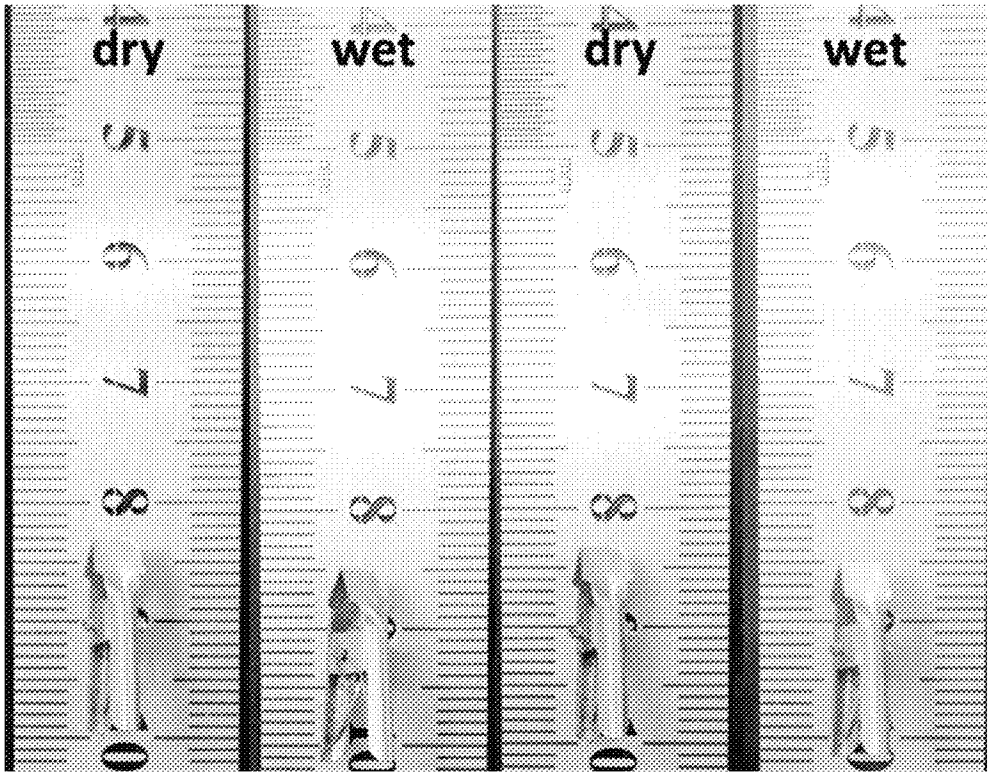
FIG. 31B shows the 8-cm single 45 μm regenerated silk fiber lifting a 400 mg metal clip during repeated cycles of wetting and drying. The average displacement was 2 mm (2.5%)

FIGS. 31A and 31B display a cyclic lifting of weight by an 8 cm long silk fiber in response to five cycles of drying and wetting. This means the cyclic contraction of the regenerated silk can generate work and yield a work density of 69.9 $KJ/m^{-3}$, which is 1.75 times that of the muscle fibers, and comparable with some of the current artificial muscles.

Figure 32:
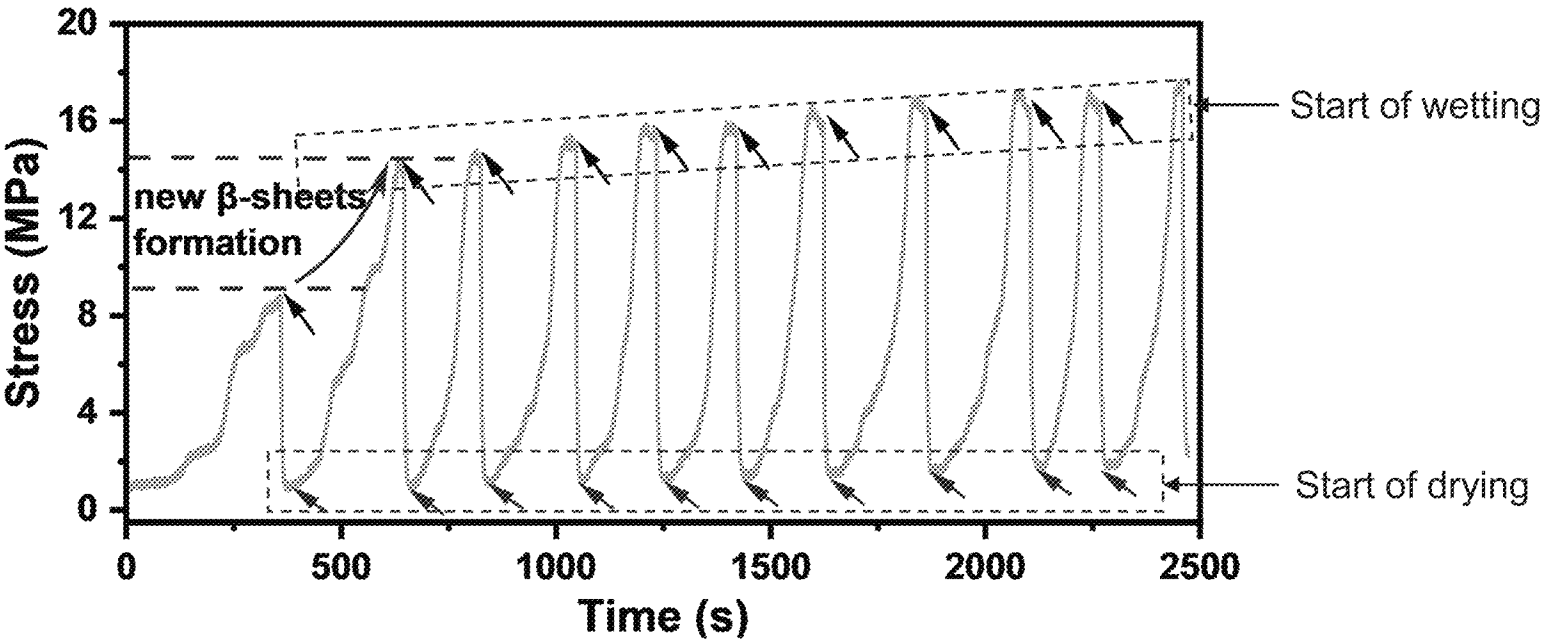
FIG. 32 shows the Cyclic stress response of a single regenerated silk fiber to humidity. Upper row of arrows refers to the start of wetting, and lower row of arrows refer to the start of drying.
Figure 33:
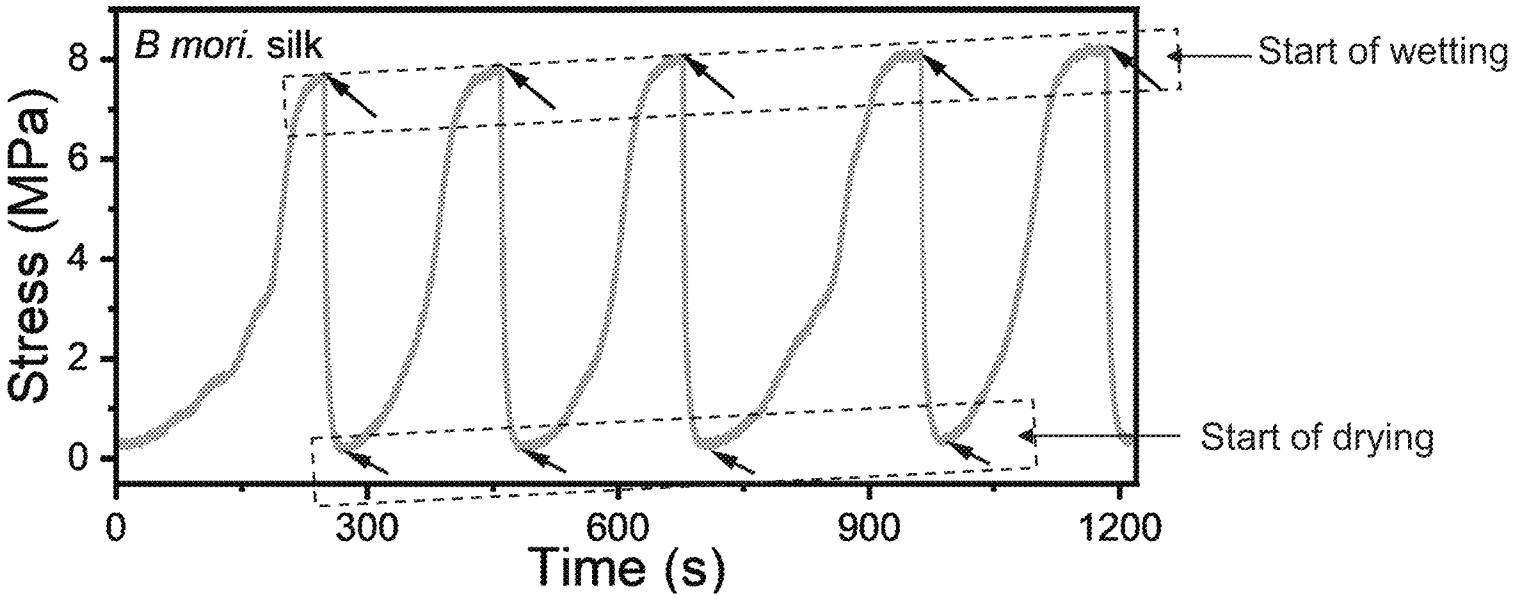
FIG. 33 shows the cyclic stress response of a single cocoon silk to humidity. Upper row of arrows refers to the start of wetting, and lower row of arrows refer to the start of drying.

The cyclic actuation force generated during the contraction cycles was quantified and is shown in FIG. 32. The test began at high humidity, and the initial drying-induced stress (contraction) was ~10 MPa. After stabilizing, the maximum contraction stress can reach ~18 MPa, which is much higher than that of silkworm silks (control) (FIG. 33). Similar to the stabilized recovery from the second cycle in the water-induced shape-memory effect under uniaxial strain, this phenomenon can be attributed to the formation of new β-sheets in the metastable protein structure.

Figure 34:
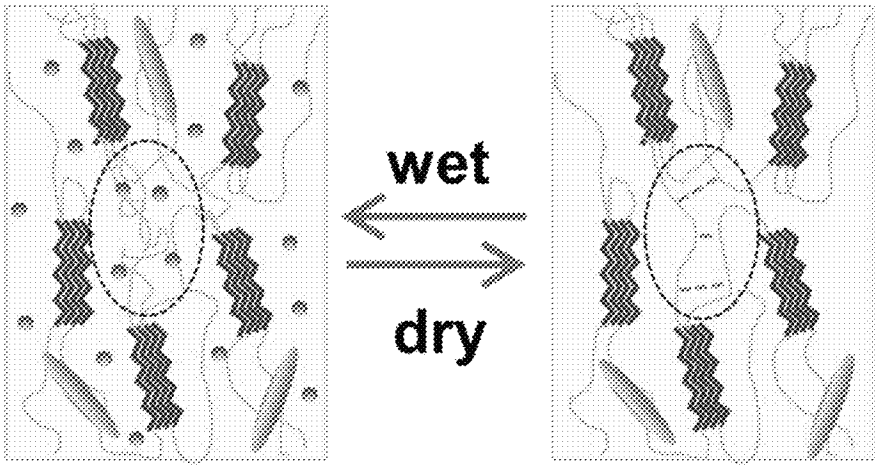
FIG. 34 is a schematic diagram illustrating the water-actuation stress response mechanism in the regenerated silk fibers.

In silk-based fibers, β-sheet crystals, glycine-rich domains, and oriented amorphous regions are all believed to be critical in the water-driven cyclic response. The contraction stress can be attributed to the interaction of hydrophilic groups in amorphous segments and water molecules, as illustrated in FIG. 34. The drying process enables the reformation of hydrogen bonds and thus shrinks the fibers, while the wetting process enables the penetration of water molecules into the amorphous regions, thus destroying the hydrogen bonds and relaxing the molecules.

Figure 35:
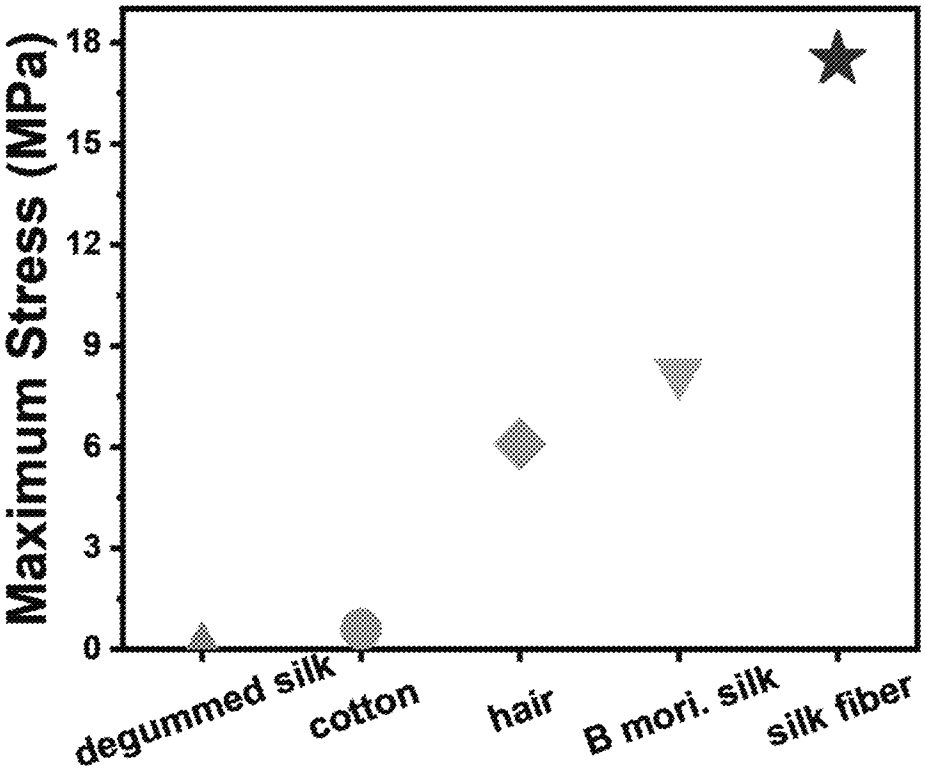
FIG. 35 shows the maximum stress generated in the water-actuated cycles of different hydrophilic natural textile fibers.

Drying-induced cyclic response has been found in many hydrophilic natural fibers such as cotton, wool, cocoon silk, and spider silk. As displayed in FIG. 35, the (regenerated) silk fibers of this work generated maximum stress during the contraction far beyond that of other traditional natural fibers. This water-driven cyclic contraction behavior makes the regenerated silk fiber of this work an outstanding candidate in fiber- and textile-based actuators.

Figure 36:
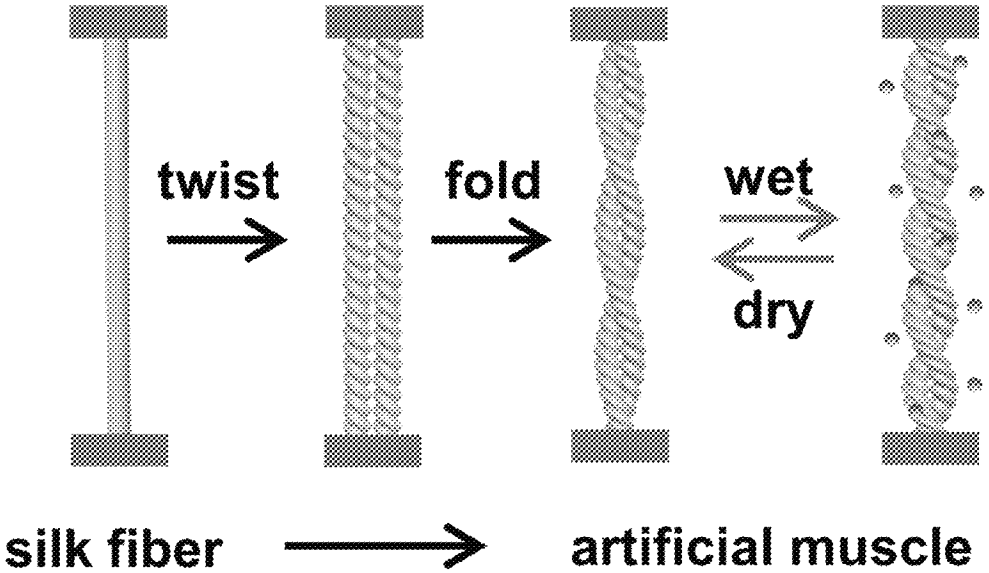
FIG. 36 is a schematic diagram illustrating the fabrication process of a yarn artificial muscle in accordance with an embodiment of the invention.
Figure 37:
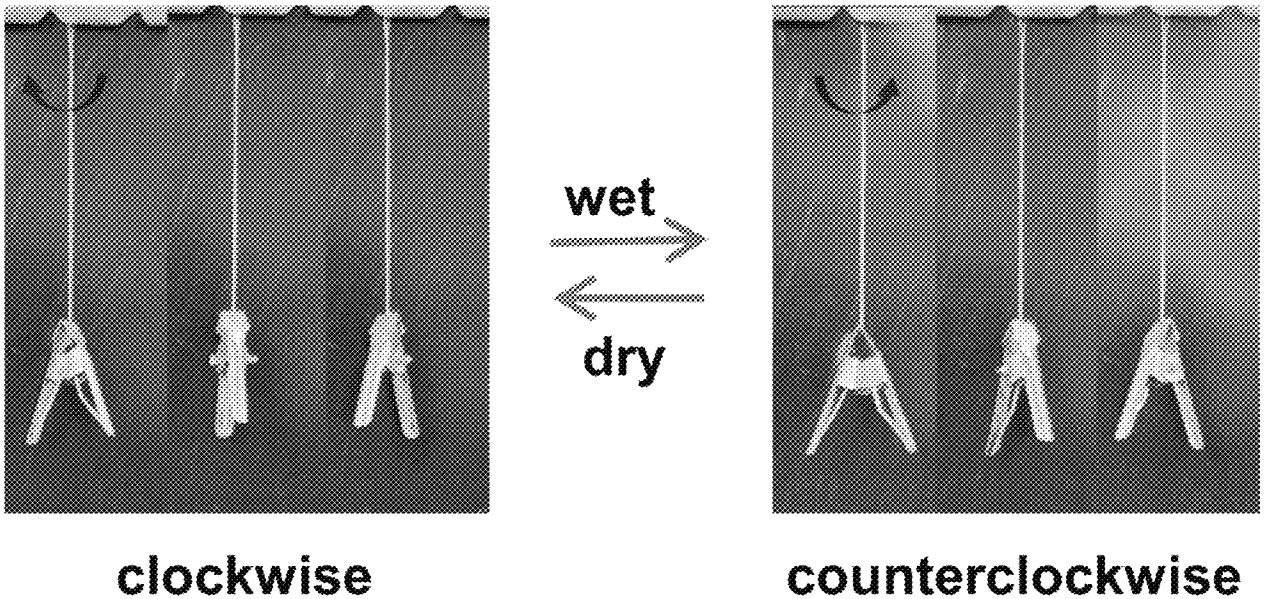
FIG. 37 shows the water-driven torsional behavior of a 2-cm silk yarn artificial muscle.

The cyclic response to water enables the regenerated silk fibers to be applied as smart textiles. FIG. 36 displays that a yarn-structured artificial muscle can be made by twisting and folding of the regenerated silk fibers of this work. The as-made yarn artificial muscle is responsive to water by showing a clockwise torsion upon wetting and a counter-clockwise torsion upon drying (FIG. 37).

Figure 38:
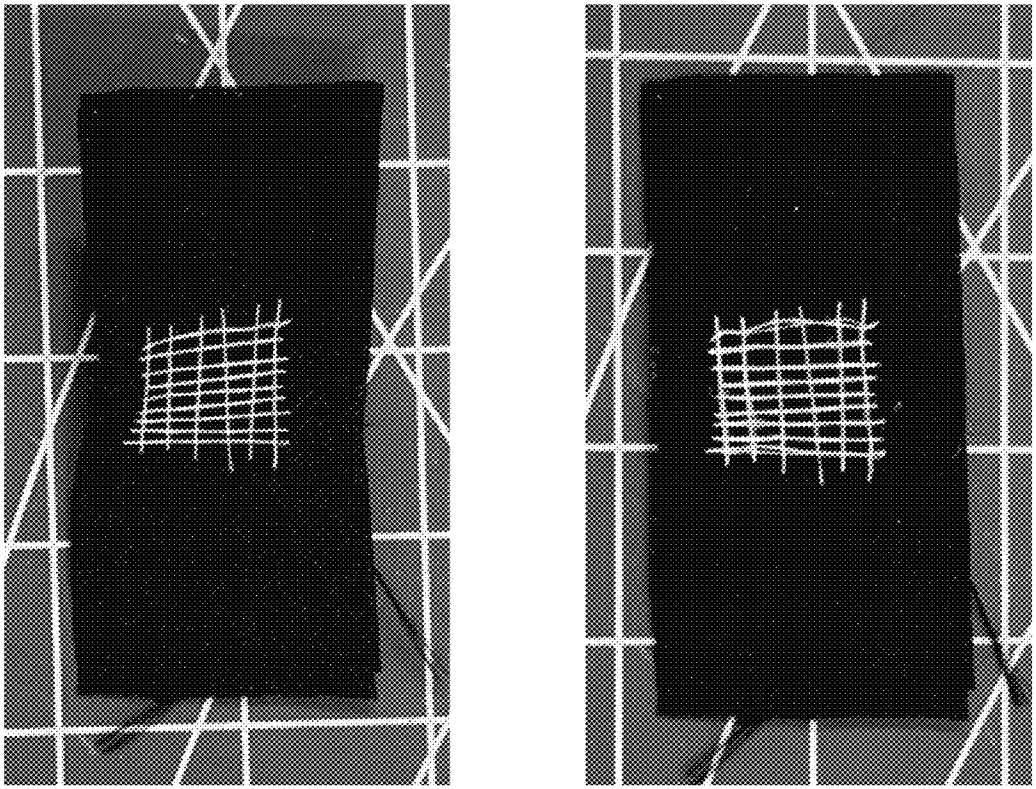
FIG. 38 shows the top view of a prototype of the two-layered smart fabric using regenerated silk fibers as one woven fabric. The left is the fabric in the dry state, and the right is the fabric in the wet state.
Figure 39:
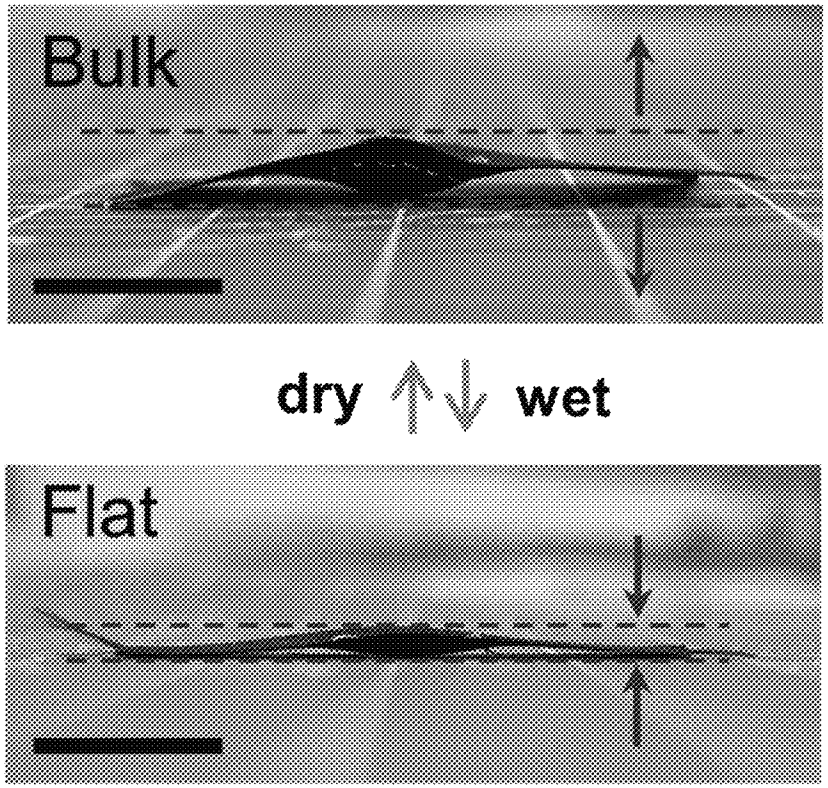
FIG. 39 shows the side view of a prototype of a self-modulated fabric actuated by water. Scale bar: 1 cm.
Figure 40:
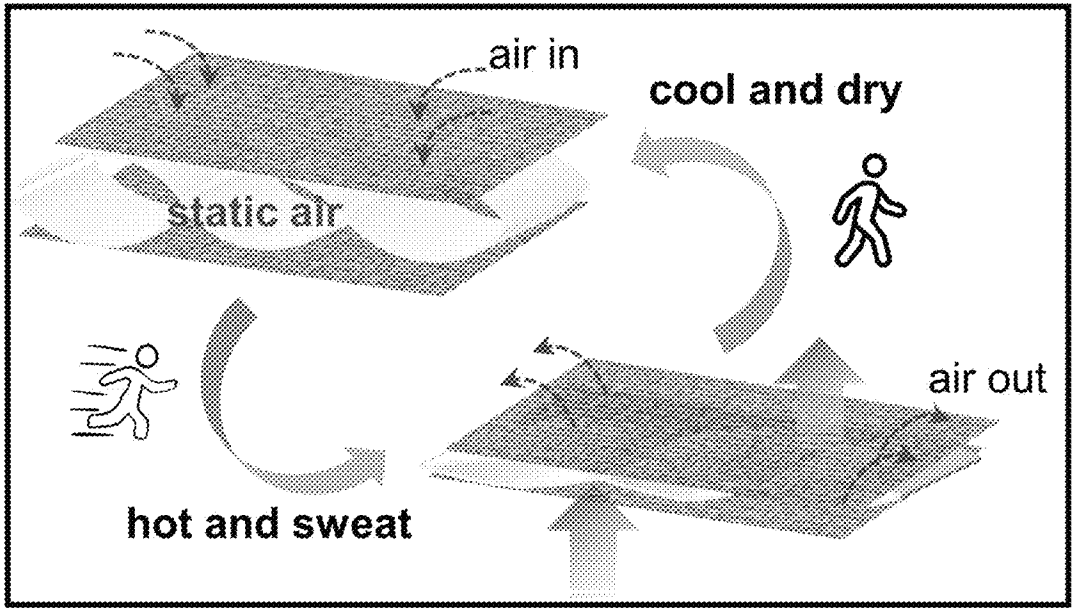
FIG. 40 is a schematic diagram illustrating the "smart fabrics" made from regenerated silk fibers applied in a practical scene, with self-modulated function for thermo-regulatory apparel.

The fiber was further processed into fabrics. A layer of woven fabric from regenerated silk fibers was sewn onto a woven fabric substrate to form a two-layer fabric (FIG. 38). The two-layer fabric showed a flat appearance upon humidifying but became bulky after drying (FIG. 39). This reversible behavior makes it suitable for application in smart textiles. FIG. 40 illustrates conceptual intelligent thermal insulation for this smart fabric, which will have an effect on thermal comfort management. Briefly, the smart fabric will change to flat after sweating, allowing the sweat to transfer. When the skin becomes dry, the fabric will bulk up and generate a larger space to contain more static air, forming an isolation layer for keeping warm. This smart fabric shows the potential in self-modulated textiles for thermal management and fiber actuators.

The invention has been given by way of example only, and various other modifications of and/or alterations to the described embodiment may be made by persons skilled in the art without departing from the scope of the invention as specified in the appended claims.

The invention claimed is:

1. A method for preparing a hydration-responsive silk-based material, comprising the steps of:

(a) providing a precursor solution including a mixture of silk fibroin, lithium bromide, and cellulose nanocrystal;

(b) wet-spinning the precursor solution into a coagulation solution to form an intermediate silk-based material; and (c) drawing the intermediate silk-based material in the coagulation solution to obtain the hydration-responsive silk-based material.

2. The method as claimed in claim 1, wherein step (a) comprises the steps of:

providing a silk fibroin solution from a natural silk;

providing a suspension solution of cellulose nanocrystal; and mixing the silk fibroin solution with the suspension solution of cellulose nanocrystal to form the precursor solution.

3. The method as claimed in claim 2, wherein the silk fibroin solution includes a mixture of silk fibroin and lithium bromide.

4. The method as claimed in claim 3, wherein the silk fibroin solution is prepared by the steps of:

degumming the natural silk in an aqueous solution of sodium bicarbonate to obtain the silk fibroin; and dissolving the silk fibroin in an aqueous solution of lithium bromide.

5. The method as claimed in claim 4, wherein the degumming is carried out in a 2% sodium bicarbonate aqueous solution at a temperature of about 90° C. to about 100° C.

6. The method as claimed in claim 4, wherein dissolving step is carried out by dissolving about 25% by weight of silk fibroin in about 8.8 M to about 9.3 M lithium bromide aqueous solution at a temperature of about 60° C.

7. The method as claimed in claim 4, wherein the natural silk is obtainable from larvae of any one of *Bombyx mori, Antheraea, Cricula, Samiz*, or *Gonometa*.

8. The method as claimed in claim 1, wherein the precursor solution includes about 20% of silk fibroin and about 0.1% to about 2% of cellulose nanocrystal.

9. The method as claimed in claim 1, wherein the cellulose nanocrystal is a sulfate-functionalized cellulose nanocrystal.

10. The method as claimed in claim 1, wherein the wet-spinning is carried out by extruding the precursor solution into a 30% ammonium sulfate aqueous solution at a rate of about 0.8 mL/h to form the intermediate silk-based material.

11. The method as claimed in claim 1, wherein step (b) includes the step of stabilizing the intermediate silk-based material in the coagulation solution.

12. The method as claimed in claim 1, wherein step (c) is carried out at a drawing ratio from about 200% to about 600%.

13. The method as claimed in claim 1 further comprising the step of converting the hydration-responsive silk-based material into a ply yarn.

14. The method as claimed in claim 13 comprising the step of plying the hydration-responsive silk-based material into a single-ply yarn or a multiple-ply yarn.

15. The method as claimed in claim 13 comprising the step of sewing the ply yarn on a fabric.

16. A hydration-responsive silk-based material prepared by the method as claimed in claim 1, comprising a hierarchical fiber structure of a plurality of cellulose nanocrystal-doped silk fibroins.

17. The hydration-responsive silk-based material as claimed in claim 16, wherein the plurality of cellulose nanocrystal-doped silk fibroins includes a plurality of cellulose nanocrystal-doped silk fibrils arranged in stack and aligned parallel to a fiber axis.

18. The hydration-responsive silk-based material as claimed in claim 17, wherein the plurality of cellulose nanocrystal-doped silk fibrils includes a semi-crystalline structure of β-sheet crystallites and amorphous α-helix/random coils doped with cellulose nanocrystals via hydrogen bond.

19. The hydration-responsive silk-based material as claimed in claim 18, wherein semi-crystalline structure includes a nematic phase.

20. The hydration-responsive silk-based material as claimed in claim 18, wherein the cellulose nanocrystals are sulfate-functionalized cellulose nanocrystals having a diameter of about 5 nm to about 20 nm and a length of about 100 nm to about 200 nm.

21. The hydration-responsive silk-based material as claimed in claim 16 is a shape-memory and stress-memory fiber that is responsive to hydration-dehydration cycles.

22. The hydration-responsive silk-based material as claimed in claim 21 has a shape fixity of about 90% and a recovery efficiency of about 83% during a shape-memory programming cycle.

23. The hydration-responsive silk-based material as claimed in claim 16 is configured as a ply yarn.

24. The hydration-responsive silk-based material as claimed in claim 23, wherein the ply yarn has a clockwise torsion in response to a humid condition and has a counter-clockwise torsion in response to a dry condition.

25. The hydration-responsive silk-based material as claimed in claim 23, wherein the ply yarn is sewable on a fabric.

* * * * *